US010710385B2

(12) United States Patent
Kakui

(10) Patent No.: US 10,710,385 B2
(45) Date of Patent: Jul. 14, 2020

(54) PRINTER

(71) Applicant: SATO HOLDINGS KABUSHIKI KAISHA, Tokyo (JP)

(72) Inventor: Yasuyuki Kakui, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/076,562

(22) PCT Filed: Apr. 14, 2017

(86) PCT No.: PCT/JP2017/015309
§ 371 (c)(1),
(2) Date: Aug. 8, 2018

(87) PCT Pub. No.: WO2018/066155
PCT Pub. Date: Apr. 12, 2018

(65) Prior Publication Data

US 2019/0061393 A1 Feb. 28, 2019

(30) Foreign Application Priority Data

Oct. 4, 2016 (JP) ..... 2016-196619

(51) Int. Cl.
*B41J 15/04* (2006.01)
*B41J 11/04* (2006.01)
(Continued)

(52) U.S. Cl.
CPC ..... *B41J 15/04* (2013.01); *B41J 2/32* (2013.01); *B41J 3/4075* (2013.01); *B41J 11/04* (2013.01);
(Continued)

(58) Field of Classification Search
CPC . B41J 15/04; B41J 15/16; B41J 15/046; B41J 15/048; B41J 11/006; B41J 11/04;
(Continued)

(56) References Cited

U.S. PATENT DOCUMENTS 5,221,150 A 6/1993 Fujioka et al.
8,564,633 B2 10/2013 Matsushima et al.
(Continued)

FOREIGN PATENT DOCUMENTS

CN 102145594 A 8/2011
CN 102975496 A 3/2013
(Continued)

OTHER PUBLICATIONS

U.S. Appl. No. 16/076,041, filed Aug. 7, 2018, Kakui.
Extended European Search Report, dated Apr. 26, 2019, 9 pages.

*Primary Examiner* — Juanita D Jackson
(74) *Attorney, Agent, or Firm* — Foley & Lardner LLP

(57) ABSTRACT

A printer includes a platen roller portion (23) that feeds a continuous paper, a printing head portion (13) that performs printing on the continuous paper, and a damper portion (15) that reduces a stress acting on the continuous paper. In a case of a transition from a state where the printing head portion (13) is positioned on an open position separated from the platen roller portion (23) and the damper portion (15) is positioned on an open position separated from the continuous paper to a state where the printing head portion (13) is positioned on a closed position opposing the platen roller portion (23) and the damper portion (15) is positioned on a closed position abutting on the continuous paper, the damper portion (15) moves to the closed position after the printing head portion (13) moved to the closed position.

16 Claims, 30 Drawing Sheets

(51) Int. Cl.

| | |
|---|---|
| ***B41J 2/32*** | (2006.01) |
| ***B65H 23/16*** | (2006.01) |
| ***B41J 15/16*** | (2006.01) |
| ***B41J 3/407*** | (2006.01) |

(52) U.S. Cl.
CPC ..... *B41J 15/165* (2013.01); *B65H 23/16* (2013.01); *B65H 2402/64* (2013.01); *B65H 2801/12* (2013.01)

(58) Field of Classification Search
CPC . B41J 11/27; B41J 25/001; B41J 13/18; B41J 13/32; B41J 29/13; B41J 2/32
See application file for complete search history.

(56) References Cited

U.S. PATENT DOCUMENTS

| | | | |
|---|---|---|---|
| 8,845,088 | B2 | 9/2014 | Tsuchiya |
| 9,656,489 | B2 | 5/2017 | Kokuta |
| 9,718,285 | B2 | 8/2017 | Kokuta |
| 9,908,344 | B2 | 3/2018 | Onodera et al. |
| 10,022,988 | B2 | 7/2018 | Onodera et al. |
| 2011/0193927 | A1 | 8/2011 | Matsushima et al. |
| 2013/0056513 | A1 | 3/2013 | Tsuchiya |
| 2013/0057631 | A1 | 3/2013 | Tsuchiya |
| 2016/0318320 | A1 | 11/2016 | Kokuta et al. |
| 2016/0325563 | A1 | 11/2016 | Kokuta |
| 2016/0325568 | A1 | 11/2016 | Onodera |
| 2017/0001457 | A1 | 1/2017 | Kokuta |
| 2017/0080726 | A1 | 3/2017 | Onodera |
| 2017/0305173 | A1 | 10/2017 | Onodera et al. |

FOREIGN PATENT DOCUMENTS

| | | | | |
|---|---|---|---|---|
| EP | 3 088 196 | A1 | | 11/2016 |
| JP | 64-008072 | A | | 1/1989 |
| JP | 08-157120 | A | | 6/1996 |
| JP | 11-246092 | A | | 9/1999 |
| JP | 2000-052613 | A | | 2/2000 |
| JP | 2000052613 | A | * | 2/2000 |
| JP | 2007-126230 | A | | 5/2007 |
| JP | 2007-210264 | A | | 8/2007 |
| JP | 2007-301869 | A | | 11/2007 |
| JP | 2009-101656 | A | | 5/2009 |
| JP | 2010-076137 | A | | 4/2010 |
| JP | 2010-076851 | A | | 4/2010 |
| JP | 2010-184395 | A | | 8/2010 |
| JP | 2011-161817 | A | | 8/2011 |
| JP | 2012-091517 | A | | 5/2012 |
| JP | 2015-123626 | A | | 7/2015 |
| WO | WO-2010/035357 | A1 | | 4/2010 |

* cited by examiner

PRINTER

TECHNICAL FIELD

The present invention relates to a printer configured to print desired information such as a character, a sign, a diagram, a barcode, or similar information, on a print medium such as a label.

BACKGROUND ART

In fields of manufacturing, managing, distribution and the like of a product, a tag that includes visibly printed information on the product and is attached to the product, and a label directly attached to an object (hereinafter referred to as an adhered body) such as the product are used.

As an example, in the case of the label, the label is prepared as a continuous paper where a plurality of labels are temporarily adhered on a long strip-shaped liner sheet (hereinafter referred to as a continuous paper). In view of this, a printer configured to perform printing on individual labels on this continuous paper is used.

The printer configured to perform printing on the labels temporarily adhered on the continuous paper includes a printing unit that has a thermal head for printing on supplied continuous paper, and a damper portion that reduces a stress applied to the continuous paper. The printer is configured to have a printing start position of the continuous paper adjusted to a position corresponding to the thermal head of the printing unit. Inside the printer, the damper portion is disposed on a feed path for the continuous paper where the continuous paper is pressed onto the damper portion.

Usually, a printer requires an operation for setting a continuous paper on a feed path each time when replacement of the continuous paper, maintenance, and similar work are performed. This printer having the configuration where the damper portion is pressed onto the continuous paper has a labor in the operation for setting the continuous paper on the feed path.

Therefore, there has been proposed a printer where a damper portion configured to be openable along with a printing unit eases an operation for setting a continuous paper on a feed path (see JP2015-123626A).

The printer described in JP2015-123626A has the configuration where, when a user operates the printing unit to an open state, the damper portion transitions to an open state in conjunction with the behavior of the printing unit. When the user operates the printing unit to a closed state, the damper portion is configured to transition to a closed state in conjunction with the behavior of the printing unit.

SUMMARY OF INVENTION

On the printer described in JP2015-123626A, it has become apparent that in a process where the printing unit and the damper portion in an interlocking structure are transitioned from the opened state to the closed state, the damper portion disposed on an upstream side in a feed direction with respect to the printing unit moves a position of the continuous paper immediately before the printing unit nips the continuous paper, then the printing unit fails to nip the continuous paper in some cases.

When a next printing start position of the continuous paper is displaced off a position corresponding to a printing head portion, the setting operation for the continuous paper needs to be performed again, thus the operation becomes difficult.

Therefore, it is an object of the present invention to prevent a positional displacement of a continuous paper due to opening and closing operations of a printing unit and a damper portion at a setting operation without reducing workability in setting the continuous paper to the printing unit and the damper portion.

According to an aspect of the present invention, there is provided a printer that performs printing on a long strip-shaped continuous paper. The printer includes a platen roller portion, a printing head portion, and a damper portion. The platen roller portion is configured to feed the continuous paper. The printing head portion is disposed movable to a closed position and an open position. The closed position opposes the platen roller portion. The open position is separated from the platen roller portion. The printing head portion is configured to perform printing on the continuous paper. The damper portion is disposed on an upstream side of the printing head portion in a feed direction of the continuous paper. The damper portion is movable to a closed position abutting on the continuous paper and an open position separated from the continuous paper. The damper portion is configured to reduce a stress applied to the continuous paper. In a case of a transition from a state where the printing head portion is positioned on the closed position opposing the platen roller portion and the damper portion is positioned on the closed position abutting on the continuous paper to a state where the printing head portion is positioned on the open position separated from the platen roller portion and the damper portion is positioned on the open position separated from the continuous paper, moving the printing head portion to the open position moves the damper portion to the open position in conjunction with the printing head portion. In a case of a transition from a state where the printing head portion is positioned on the open position separated from the platen roller portion and the damper portion is positioned on the open position separated from the continuous paper to a state where the printing head portion is positioned on the closed position opposing the platen roller portion and the damper portion is positioned on the closed position abutting on the continuous paper, the damper portion moves to the closed position after the printing head portion moved to the closed position.

The above-described aspect can prevent a printing failure caused by the positional displacement of the continuous paper due to the opening and closing operations of the printing unit and the damper portion at the operation without reducing workability in setting the supplied continuous paper to the printing unit and the damper portion.

DESCRIPTION OF EMBODIMENTS

Figure 1:
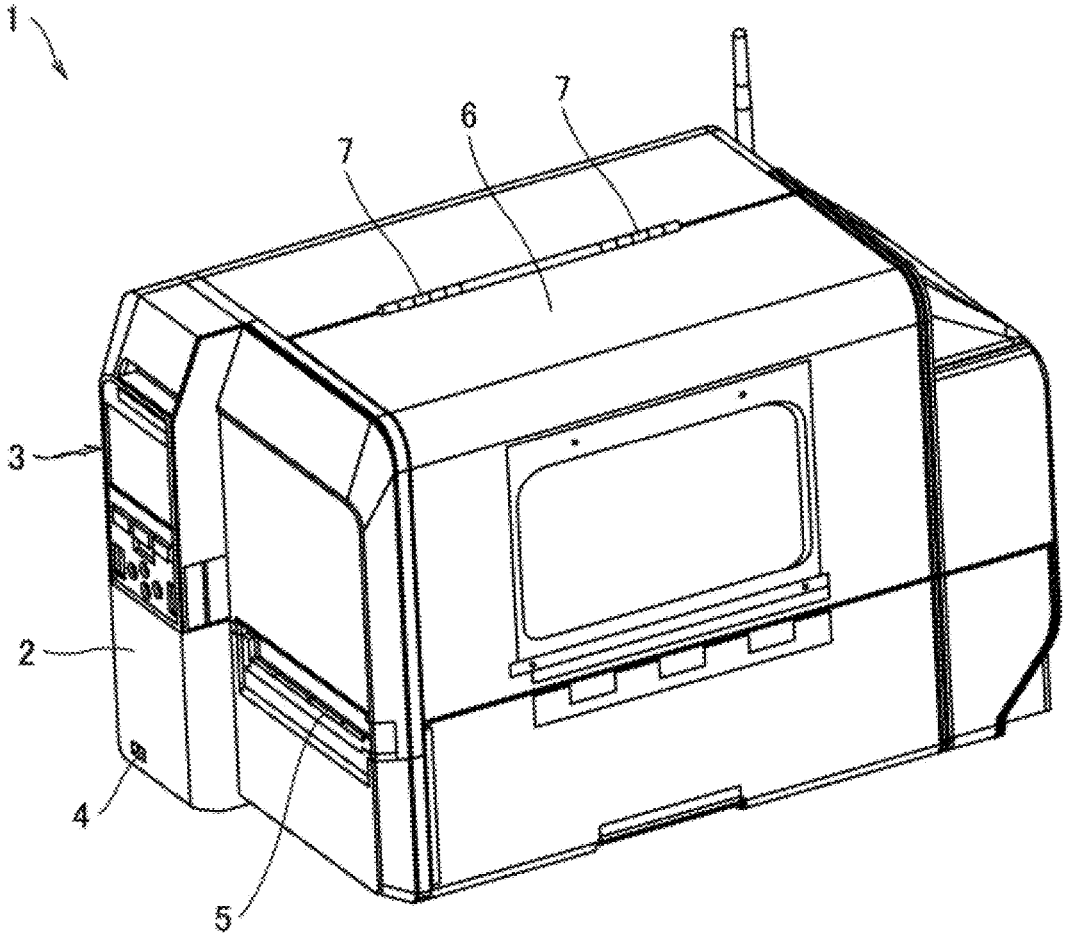
FIG. 1 is an overall perspective view of an appearance of a printer according to one embodiment of the present invention.

The following describes an embodiment as an example of the present invention in detail based on drawings. It should be noted that in the drawings to describe the embodiment, an identical reference numeral is basically attached to an identical component, and its repeated description is omitted.

A feed direction for printing a continuous paper (print medium), specifically a direction feeding the continuous paper from a paper sheet supply unit to a thermal head portion, is referred to as a printing direction, and if there is no specific description, an upstream in the feed direction is referred to as an upstream side in the printing direction, and a downstream in the feed direction is referred to as a downstream side in the printing direction.

FIG. 1 is an overall perspective view of an appearance of a printer 1 according to the embodiment.

A printer 1 according to the embodiment has, for example, a label printing function, which prints information such as a character, a sign, a diagram, a barcode, or similar information, on a label adhered temporarily on a liner sheet.

On a front cover portion 2 at a front of the printer 1, an operational panel unit 3, a power switch 4, and an issue port (medium ejection port) 5 are disposed.

On the operational panel unit 3, an LCD (liquid crystal display), which displays a message or similar information, a plurality of keys (line key, feed key, function key, direction indicating key, cancel key, and similar key), which operate an operation of the printer 1, and a plurality of LEDs (Light Emitting Diodes), which indicate a state of the printer 1, are disposed.

On one side surface of the printer 1, an open cover portion 6 is openably/closably mounted in an up-and-down direction by hinge portions 7 at two sites.

Figure 2:
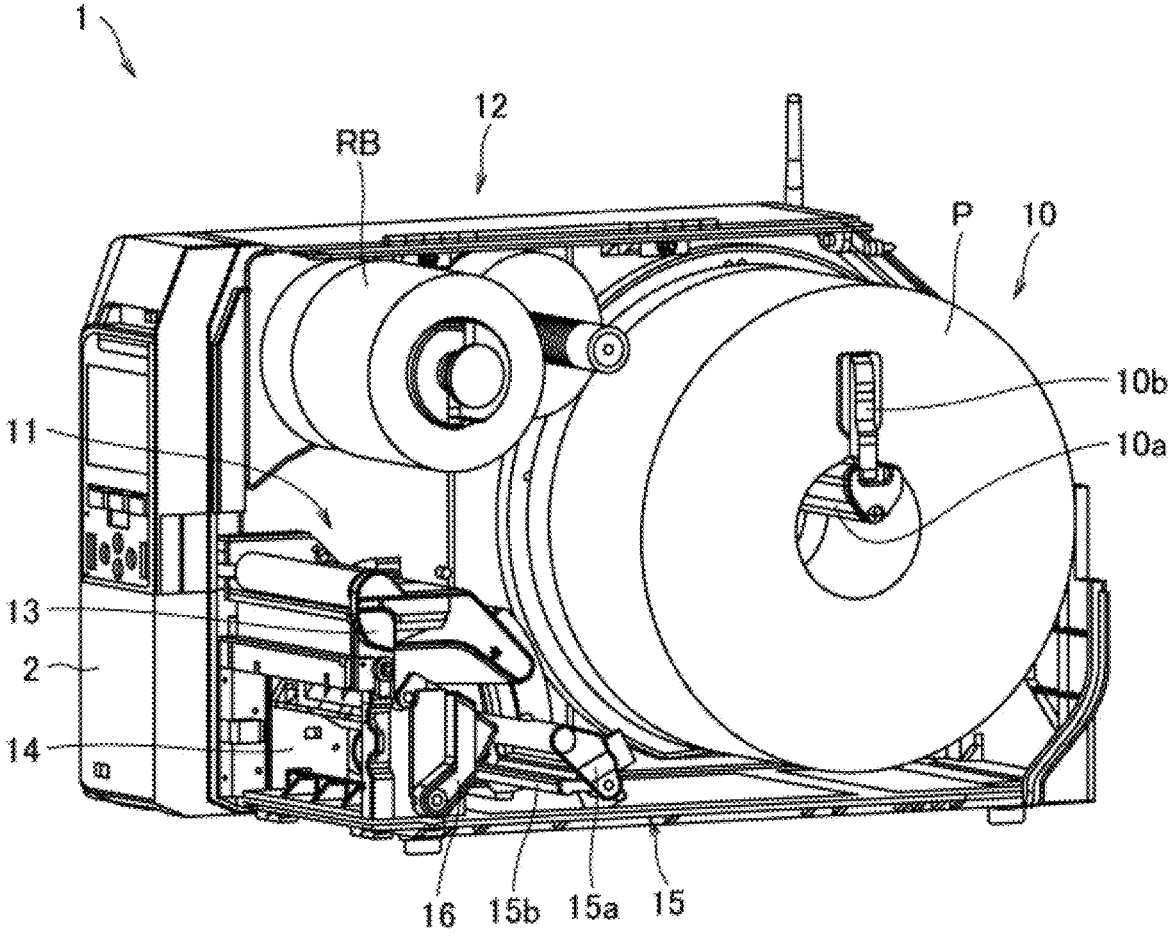
FIG. 2 is a perspective view illustrating an inside of the printer in FIG. 1.
Figure 3:
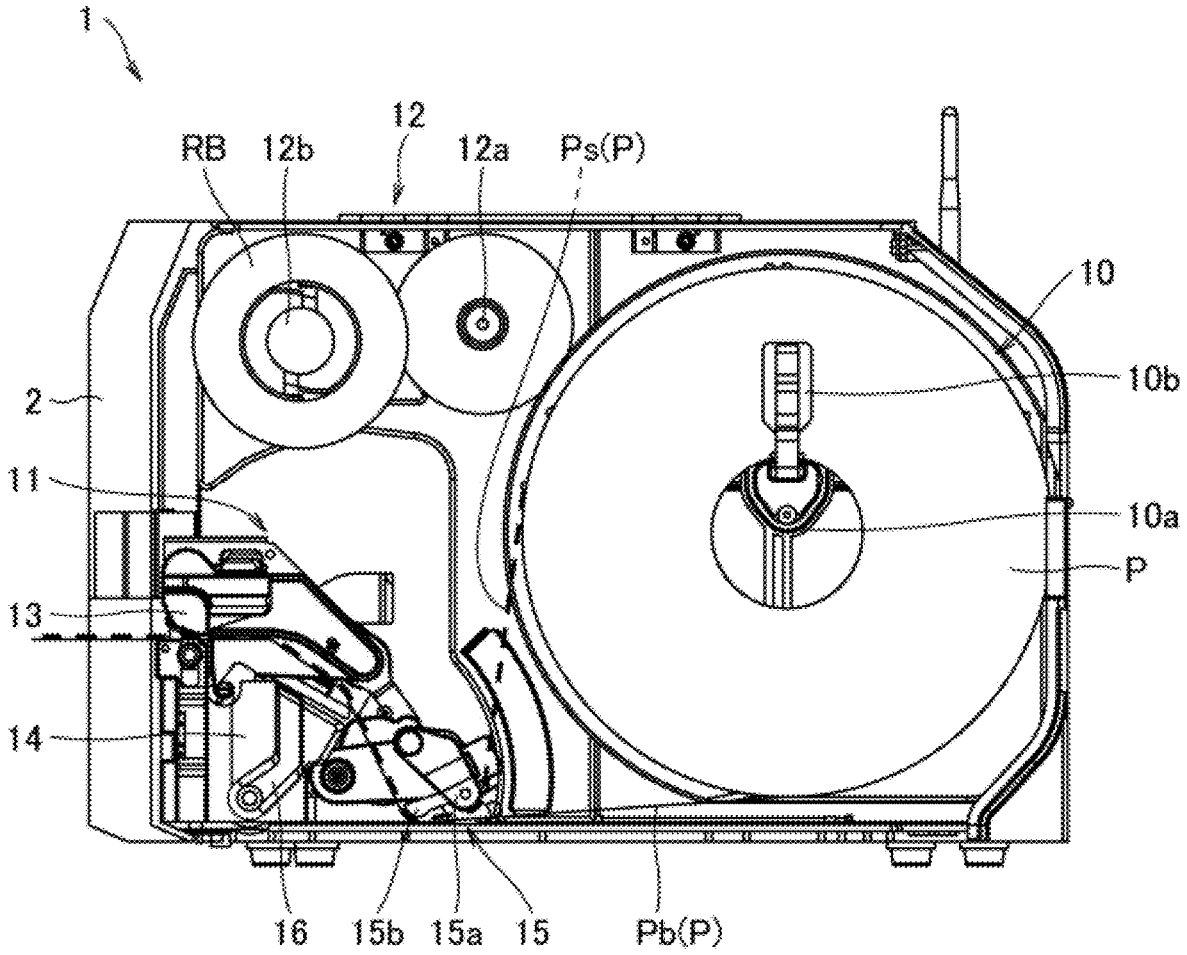
FIG. 3 is a side view of the printer in FIG. 2.

Next, an internal structure of the printer 1 will be described with reference to FIG. 2 and FIG. 3. FIG. 2 is a perspective view for illustrating an inside of the printer 1 in FIG. 1, and FIG. 3 is a side view of the printer 1 in FIG. 2. It should be noted that in the following description, a front side of the printer 1 (front cover portion 2 side) is referred to as a front (a downstream side in the feed direction of the continuous paper), and its opposite side, a back side (back cover portion side) is referred to as a rear (an upstream side in the feed direction of the continuous paper).

Inside the printer 1, a paper sheet supply unit (medium supply unit) 10, which is disposed on its rear, a printing unit 11, which is disposed on its front, and an ink ribbon portion 12, which is disposed on its upper side, are installed.

The paper sheet supply unit 10, which is a configuration unit that supplies a continuous paper (print medium) P to the printing unit 11, includes a support shaft 10*a* and a roll guiding portion 10*b*, which is installed at one end of the support shaft 10*a*.

The support shaft 10*a* is a configuration portion that rotatably supports the continuous paper P rolled up in a rolled shape. The roll guiding portion 10*b*, which is a configuration portion that restricts a move of the rolled continuous paper P, is movably installed along an axial direction of the support shaft 10*a* to be able to change its position corresponding to a width of the continuous paper P.

The continuous paper P includes, for example, a long liner sheet and a plurality of labels adhered temporarily at every predetermined interval along a longitudinal direction of the liner sheet. On a surface where an adhesive surface of the label contacts on the liner sheet, a releasing agent such as silicone or similar material is coated, and this ensures the label to be peeled off easily. On a surface where the label is not applied on the liner sheet, position detection marks, which indicate a position of the label, are formed at every predetermined interval along the longitudinal direction. For the label, there is a case where a thermal paper is used and a case where a plain paper is used. In the case of the thermal paper, on its surface, a thermal coloring layer, which develops a specific color (such as black or red) when reaching a predetermined temperature region, is formed.

There are two types of continuous papers P: an outside wound label and an inside wound label. The outside wound label is wound in a state where the label of the continuous paper P is positioned on an outer peripheral surface of the rolled continuous paper P, and as shown in FIG. 3, a continuous paper Ps (P: dashed line) is unwound from around the center in a height direction of the paper sheet supply unit 10 toward a bottom portion of the printing unit 11. In contrast, the inside wound label is wound in a state where the label of the continuous paper P is positioned on an inner peripheral surface side of the rolled continuous paper P, and as shown in FIG. 3, a continuous paper Pb (P: solid line) is unwound from around an internal bottom surface of the printer 1 toward the bottom portion of the printing unit 11. It should be noted that for both outside wound and inside wound, paper passing routes of the continuous paper P (Ps, Pb) in the printing unit 11 are identical. For both outside wound label and inside wound label, the continuous paper P is fed in a state where a surface where the label is temporarily adhered (surface for printing) is upward.

The printing unit 11, which is a configuration unit that prints on the label of continuous paper P or a similar print medium, includes a printing head portion 13, a supporting stand 14, which is disposed below the printing head portion 13, and a damper portion 15, which is disposed on a rear (upstream of feed of the continuous paper P at a printing process) of them.

The printing head portion 13 is, as described below, installed inside the printer 1 in a state of being freely opened/closed by swing. The continuous paper P is fed from a medium feed path between the printing head portion 13 in a case of being positioned on a closed position (a position in contact with a platen roller portion 23) and the supporting stand 14 to an issue port 5 (see FIG. 1).

On the supporting stand 14, a head lock lever portion 16, which maintains the closed state (the state of being positioned on the closed position) of the printing head portion 13, is installed. Operating this head lock lever portion 16 releases the closed state of the printing head portion 13 and then a front portion of the printing head portion 13 is lifted to open the printing head portion 13 (the printing head portion 13 separates from the platen roller portion 23).

The damper portion 15 is a configuration portion that reduces a stress acting on the continuous paper P. According to the embodiment, the damper portion 15 includes an outer damper portion 15*a* and an inner damper portion 15*b*. When the printing head portion 13 is positioned on the closed position, the outer damper portion 15*a* and the inner damper portion 15*b* are swingably installed such that each can reduce the stress acting on the continuous paper P.

The ink ribbon portion 12, which is a configuration portion that supplies and rolls up an ink ribbon where printing ink is applied, includes a ribbon supply unit 12*a* and a ribbon roll up unit 12*b*, which is disposed on a lateral of a front of the ribbon supply unit 12*a*. The ribbon supply unit 12*a* is a configuration unit that rotatably supports the ink ribbon rolled up in a rolled-shape. The ribbon roll up unit 12*b* is a configuration unit that rolls up and recovers the already printed ink ribbon RB. It should be noted that when using the ink ribbon, the ink ribbon extracted from the ribbon supply unit 12*a* is passed through below the printing head portion 13, and then rolled up by the ribbon roll up unit 12*b*.

According to such printer 1, the continuous paper P (Ps, Pb), which is unwound from the paper sheet supply unit 10 in a sheet-shape, is fed to the paper passing route between the printing head portion 13 and the supporting stand 14 via the damper portion 15, and in the middle of this, after a printing processing is executed on the label of the continuous paper P or a similar print medium, is ejected outside the printer 1 from the issue port 5.

Figure 4A:
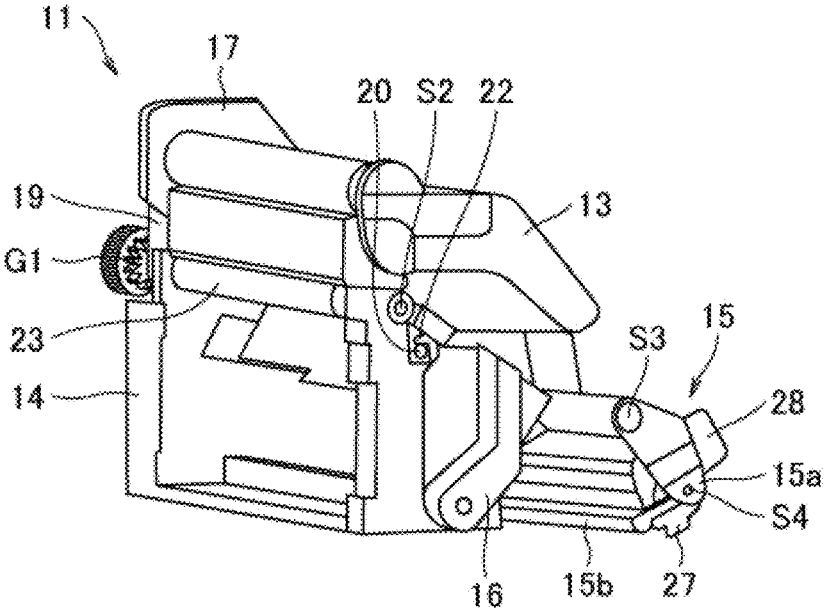
FIG. 4A is an enlarged perspective view of a printing unit viewed from a front when a printing head portion in FIG. 3 is positioned on a closed position.
Figure 4B:
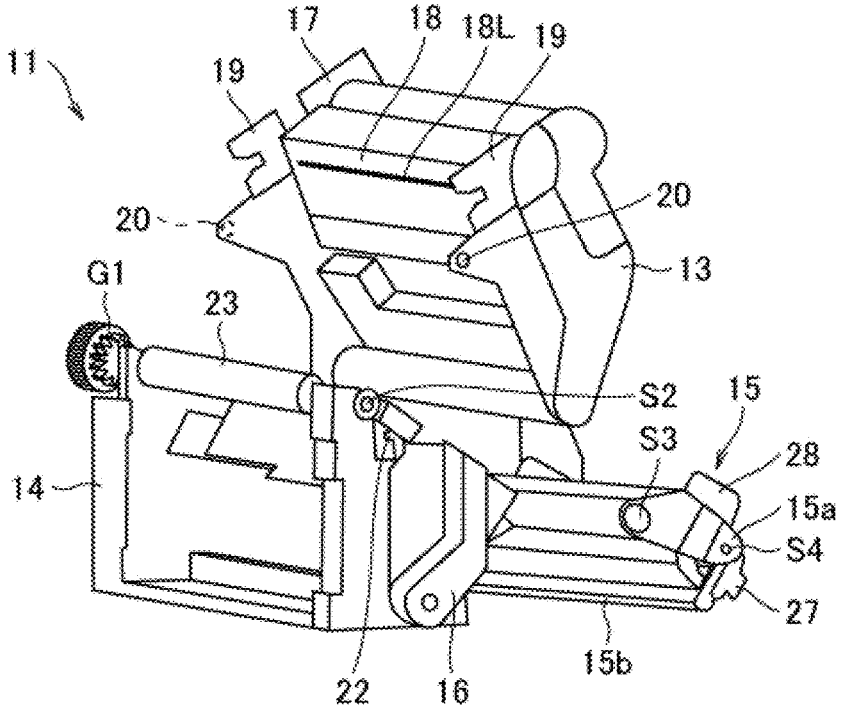
FIG. 4B is an enlarged perspective view of the printing unit viewed from a front when the printing head portion in FIG. 3 is positioned on an open position.
Figure 5:
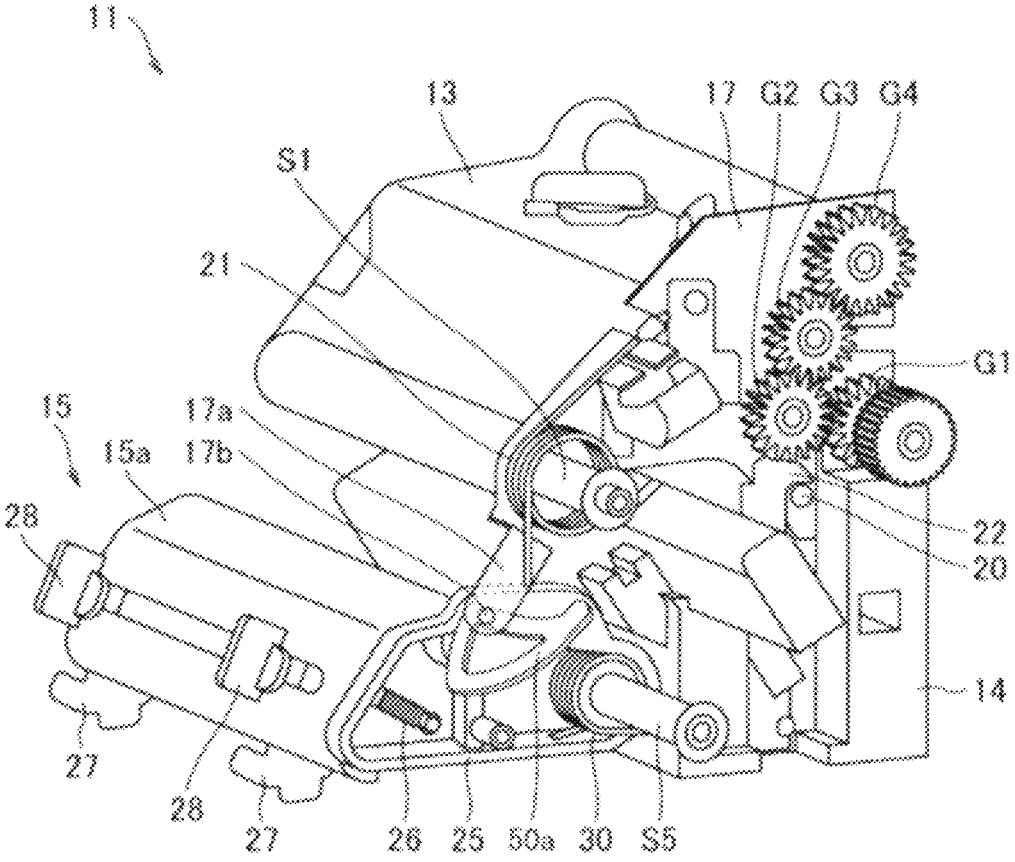
FIG. 5 is an enlarged perspective view of the printing unit in FIG. 4A viewed from a back side.
Figure 6:
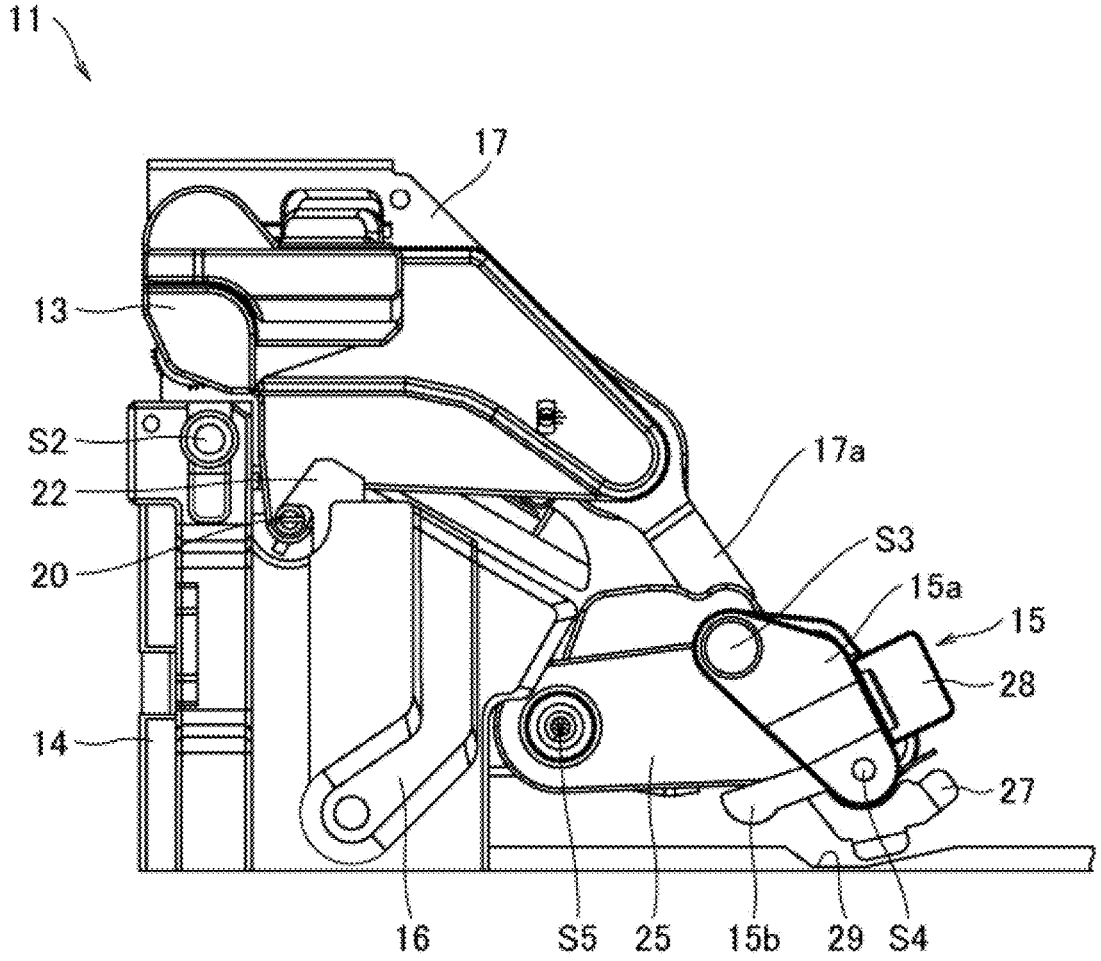
FIG. 6 is an enlarged side view of the printing unit in FIG. 3.
Figure 7:
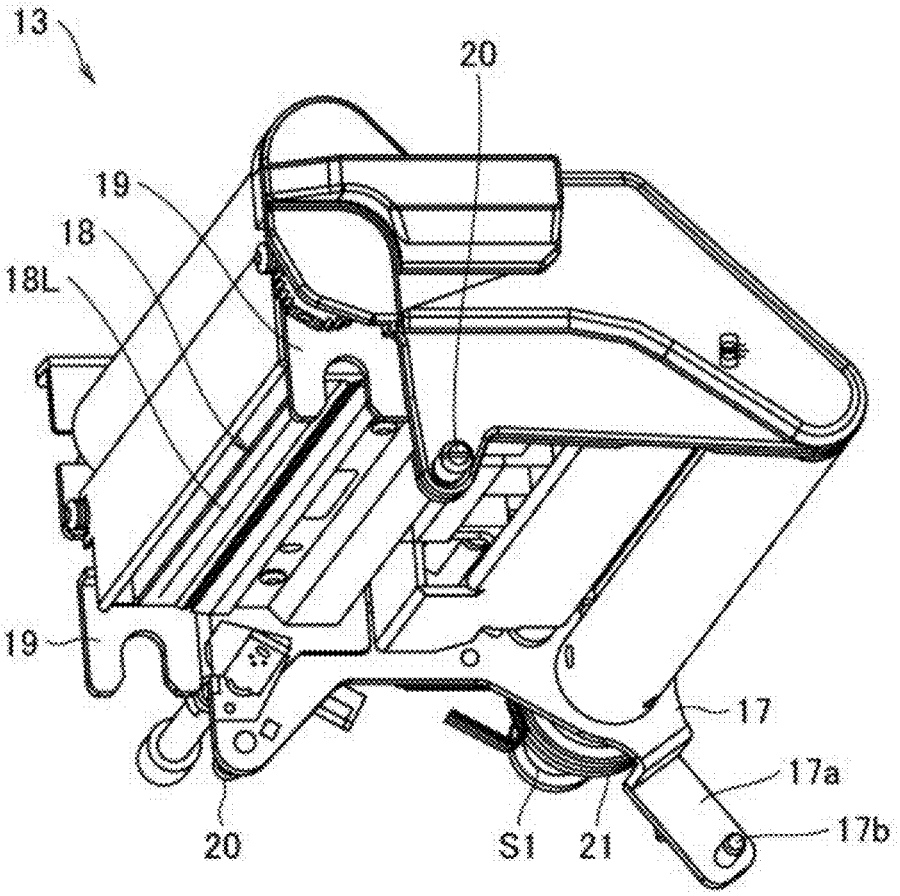
FIG. 7 is a perspective view of an extracted printing head portion in FIG. 6 viewed from a lower side.

Next, a configuration of the above-described printing unit 11 will be described with reference to FIG. 4A and FIG. 4B to FIG. 7. FIG. 4A is an enlarged perspective view of a printing unit viewed from a front when the printing head portion in FIG. 3 is positioned on the closed position. FIG. 4B is an enlarged perspective view of the printing unit viewed from a front when the printing head portion in FIG. 3 is positioned on an open position. FIG. 5 is an enlarged perspective view of the printing unit in FIG. 4A viewed from a back side of the printer 1. FIG. 6 is an enlarged side view of the printing unit in FIG. 3. FIG. 7 is a perspective view of an extracted printing head portion in FIG. 6 viewed from a lower side.

The printing head portion 13 is supported by a head supporting portion 17 (corresponding to a first support body) on one side surface of the printing head portion 13 having a front portion swingable (that is, openable and closable) in an up-and-down direction around a rocking shaft S1 (see FIG. 5 and FIG. 7) on a rear side.

On an inferior surface (surface facing the paper passing route) of the printing head portion 13, a thermal head portion 18 (see FIG. 4B and FIG. 7) is installed in a state where its printing surface faces the continuous paper disposed along the paper passing route. The thermal head portion 18 is printing means that prints on the label of the continuous paper P and similar print medium with heating resistors of a printing line 18L disposed on a printing surface of the thermal head portion 18. On this printing line 18L, a plurality of heating resistors (heating elements), which generates heat by energization, are arranged along a width direction (direction perpendicular to the feed direction of the continuous paper P) of the continuous paper P.

On an inferior surface of a front side of the printing head portion 13, depressed claw portions 19, 19 (see FIG. 4B and FIG. 7) are disposed so as to sandwich the thermal head portion 18. On the inferior surface of the printing head portion 13, pins 20, 20, which project outward from both side surfaces of the printing head portion 13, are disposed on a rear of the depressed claw portion 19.

While such printing head portion 13 is biased in the opening direction by a torsion spring 21 mounted on the rocking shaft S1 (see FIG. 5 and FIG. 7), lock claw portions 22, 22 of the supporting stand 14 are hooked to the pins 20, 20 on a lower portion of the printing head portion 13, thus maintaining the closed state. Pulling the above-described head lock lever portion 16 rightward in FIG. 6 moves the lock claw portion 22 rightward in FIG. 6 along with this, thus unhooking the lock claw portion 22 from the pin 20. When the lock claw portion 22 is unhooked from the pin 20, as illustrated in FIG. 4B, the printing head portion 13 is configured to be automatically opened by biasing force of the torsion spring 21

When the printing head portion 13 is positioned on the closed position, while a printing surface of the thermal head portion 18 is pressed to the platen roller portion 23 (see FIG. 4A and FIG. 4B), which is below the thermal head portion 18, the depressed claw portions 19, 19 (see FIG. 4B and FIG. 7) of the printing head portion 13 are fitted to both end portions of a turning shaft S2 (see FIG. 4A, FIG. 4B, and FIG. 6) of the platen roller portion 23.

The platen roller portion 23 is feeding means that feeds the continuous paper P unwound from the paper sheet supply unit 10 to the issue port 5 (see FIG. 1) along the paper passing route, and a surface of the platen roller portion 23 is coated with elastic material such as hard rubber. This platen roller portion 23 is turnably in normal and reverse directions installed on an upper portion of the supporting stand 14. To one end in an axial direction of the turning shaft S2 of the platen roller portion 23, a gear G1 is engaged. This gear G1, for example, is engaged with a turning shaft of a driver (not illustrated) such as a stepping motor via a timing belt (not illustrated) and the like. The gear G1 is engaged to a gear G4 via concatenation gears G2 and G3 (see FIG. 5).

According to the embodiment, on an end portion on the damper portion 15 side on the head supporting portion 17, which supports the printing head portion 13, a restricting portion 17*a* (see FIG. 5 to FIG. 7) is integrally formed. This restricting portion 17*a* is formed on an end portion on an upstream side in the feed direction as an opposite position of a front portion of the head supporting portion 17 with respect to the rocking shaft S1. On a surface facing the damper portion 15 on a distal end side of this restricting portion 17*a*, a pin 17*b* (see FIG. 7), which projects from its surface, is disposed. The restricting portion 17*a* and the pin 17*b* are parts of a mechanism that transmits the opening and closing operations of the printing head portion 13 to the damper portion 15. This opening and closing mechanism will be described later in detail.

It should be noted that in the paper passing route of the printing unit 11, between the thermal head portion 18 and the damper portion 15, a paper-sheet-position detecting sensor (not illustrated) is disposed. This paper-sheet-position detecting sensor, which is a sensor that detects a label position of the continuous paper P by detecting the position detection mark disposed on the continuous paper P or a liner sheet part between adjacent labels, for example, is constituted of a light reflection type or light transmission type sensor.

At the printing process, the continuous paper P is fed by turning the platen roller portion 23 in a state where the continuous paper is sandwiched between the thermal head portion 18 and the platen roller portion 23. Then, based on information detected by the paper-sheet-position detecting sensor, a printing timing is determined, and the heating resistors of the printing line 18L are selectively heated by a printing signal transmitted to the thermal head portion 18. Thus, desired information, such as a character, a sign, a diagram, a barcode, or similar information, is printed on the label of the continuous paper P.

On the other hand, the outer damper portion 15*a* of the damper portion 15, when viewing a side surface of the printing unit 11, extends obliquely downward from a front side to a rear side, and is supported by a damper supporting member 25 (corresponding to a second support body) around a rocking shaft S3 of the front side (see FIG. 4 and FIG. 6) in a state where the front portion is swingable in the up-and-down direction. It should be noted that a coil spring 26 in FIG. 5, as described later, is a member that inhibits the outer damper portion 15*a* from going excessively to an upper side (rear side), swingably supports the outer damper portion 15*a*.

The inner damper portion 15*b* of the damper portion 15, when viewing the side surface of the printing unit 11, extends obliquely downward from the rear side to the front side in contrast to the outer damper portion 15*a*, and is supported by the rear portion of the outer damper portion 15*a* around a rocking shaft S4 of the rear side (see FIG. 4, and FIG. 6) in a state where a front portion is swingable in the up-and-down direction.

At the printing process, a paper sheet contact portion of the inner damper portion 15*b* is positioned on a downstream side in the feed direction of the continuous paper P with respect to a paper sheet contact portion of the outer damper portion 15*a*. That is, the paper sheet contact portion of the inner damper portion 15*b* is disposed between the printing head portion 13 and the paper sheet contact portion of the outer damper portion 15*a*.

A height of the paper sheet contact portion of the inner damper portion 15*b* is disposed at a lower position than a height of the paper sheet contact portion of the outer damper portion 15*a*. That is, the height of the paper sheet contact portion of the inner damper portion 15*b* is disposed between the paper sheet contact portion of the outer damper portion 15*a* and a bottom surface inside the printer 1. IL should be noted that configurations of the outer damper portion 15*a* and the inner damper portion 15*b* will be described later in detail.

On a lower portion of the outer damper portion 15*a*, a width adjustment guiding portion 27 is movably installed along an axial direction of the rocking shafts S3 and S4. The width adjustment guiding portion 27 is a configuration portion that abuts on both ends of the width direction of the continuous paper P fed from the paper sheet supply unit 10, and guides the feed of the continuous paper P. This width adjustment guiding portion 27 is coupled to the guide operating portion 28 disposed on a back side of the printer 1 in the outer damper portion 15*a*. This guide operating portion 28 is a tab for, while moving the width adjustment guiding portion 27 according to the width of the continuous paper P, fixing a position of the width adjustment guiding portion 27.

According to the embodiment, on the bottom surface inside the printer 1 below the damper portion 15, a depression portion 29 (see FIG. 6) is partially formed. The depression portion 29 is disposed on a region opposing the width adjustment guiding portion 27 of the damper portion 15 on the bottom surface inside the printer 1 when the damper portion 15 is positioned on the closed position. The bottom surface of the depression portion 29 is depressed downward compared with regions other than the depression portion 29 on the bottom surface inside the printer 1. Then, when the printing head portion 13 and the damper portion 15 are positioned on the closed position, the width adjustment guiding portion 27 is arranged on a position opposing this depression portion 29. At this time, a lower end of the width adjustment guiding portion 27 is positioned below the regions other than the depression portion 29 on the bottom surface inside the printer 1. A lower end portion of the width adjustment guiding portion 27 is positioned opposing the depression portion 29 as illustrated in FIG. 5 or similar drawing. The lower end portion of the width adjustment guiding portion 27 does not contact a surface of the depression portion 29 on the bottom surface inside, and is separated from the surface of the depression portion 29 by a predetermined distance. The lower end portion of the width adjustment guiding portion 27 may be formed, for example, in an arc-shape. This depression portion 29 will be described later in detail.

Figure 8:
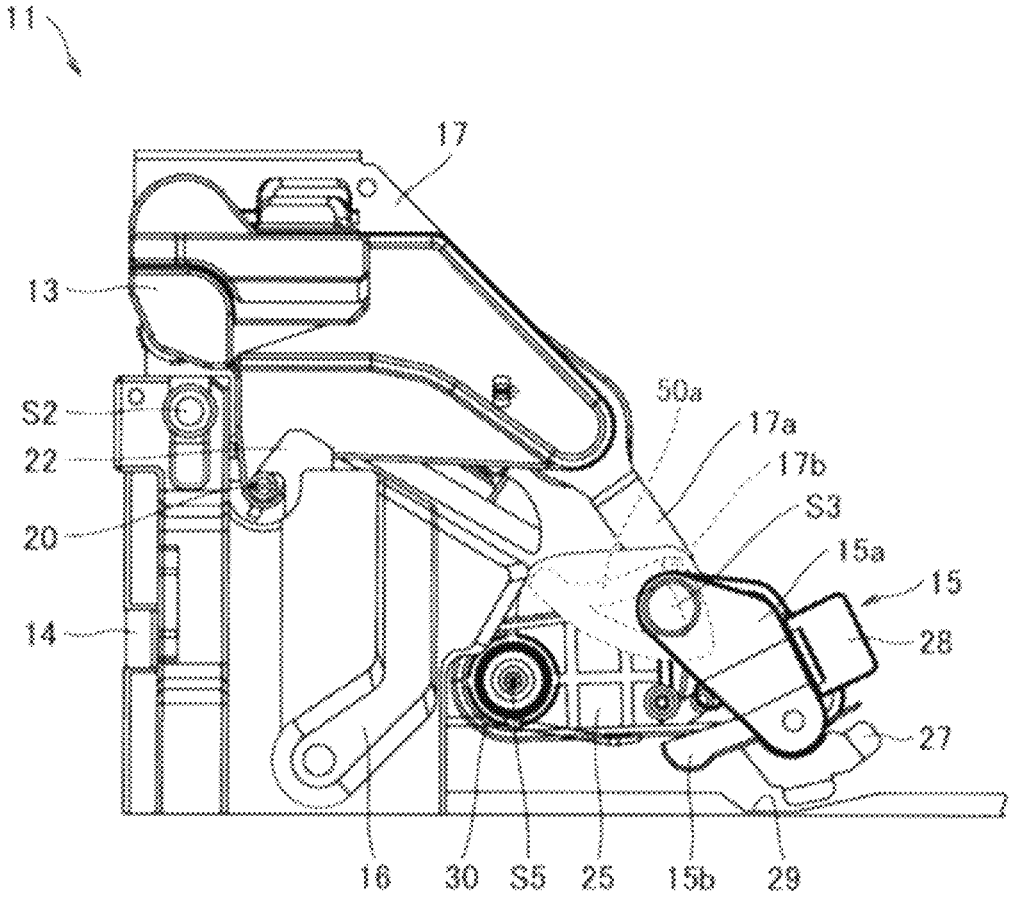
FIG. 8 is an enlarged side view of the printing unit when the printing head portion is positioned on the closed position.
Figure 9:
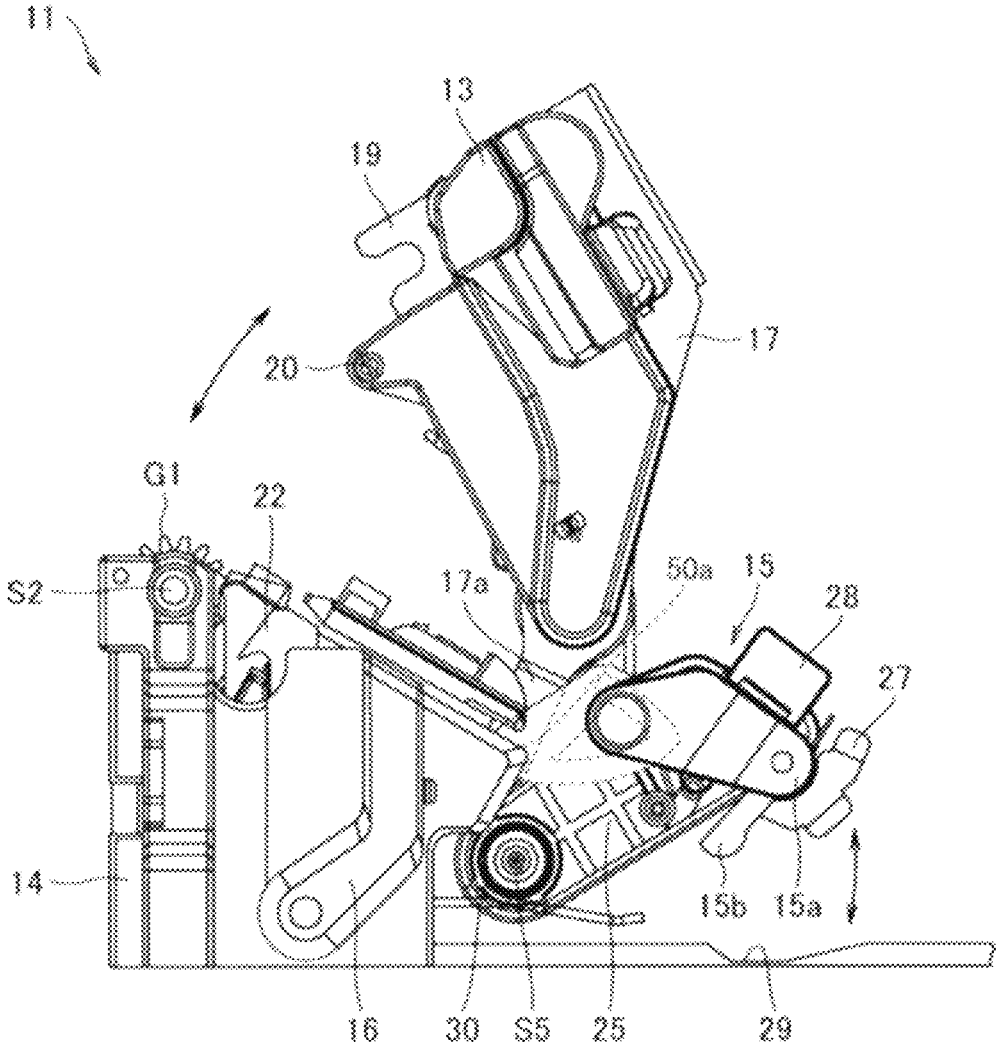
FIG. 9 is an enlarged side view of the printing unit when the printing head portion is positioned on the open position.

Next, an opening and closing operations of the damper portion 15 will be described with reference to FIG. 8 and FIG. 9. FIG. 8 is an enlarged side view of the printing unit when the printing head portion is positioned on the closed position, and FIG. 9 is an enlarged side view of the printing unit when the printing head portion is positioned on the open position. It should be noted that, in FIG. 8 and FIG. 9, a backside surface of the damper supporting member 25 is shown through.

According to the embodiment, as illustrated in FIG. 8 and FIG. 9, the damper portion 15 moves upward (that is, the opening operation) in conjunction with the opening operation of the printing head portion 13. That is, while defining a height of a reference position of the damper portion 15 as a first height when the printing head portion 13 is positioned on the closed position, opening the printing head portion 13 moves the height of the reference position of the damper portion 15 to a second height, which is higher than the first height, in conjunction with the opening of the printing head portion 13. It is configured that closing the printing head portion 13 returns the height of the reference position of the damper portion 15 to the first height after the closing operation of the printing head portion 13 is performed.

As a preparing phase for a printing operation, a user needs to open the printing head portion 13 and cause the continuous paper P extracted from the paper sheet supply unit 10 to pass through below the damper portion 15 at the proximity of the bottom surface inside the printer 1 when causing the continuous paper P to pass through the paper passing route.

The damper portion 15 is installed on the side of the bottom surface inside the printer 1, and a clearance between the damper portion 15 and the bottom surface inside the printer 1 is narrow. Therefore, provisionally, when the damper portion 15 is kept to be fixed without moving to the open state, the user has a difficulty in causing the continuous paper P to pass through the paper passing route. Furthermore, the width adjustment guiding portion 27 mounted on the lower portion of the damper portion 15 hooks the continuous paper P on the width adjustment guiding portion 27 in setting the continuous paper P, in some cases.

By these reason, provisionally, when the damper portion 15 is kept to be fixed, a problem possibly occurs that an operation setting the continuous paper P on the paper passing route of the printer 1 is difficult.

In contrast, according to the embodiment, since opening the printing head portion 13 causes the damper portion 15 to rise in conjunction with the opening of the printing head portion 13, a width for setting the continuous paper P is enlarged to improve visibility of the lower portion of the damper portion 15. This, without hooking the continuous paper P extracted from the paper sheet supply unit 10 on the width adjustment guiding portion 27, can easily pass the continuous paper P through below the damper portion 15. Accordingly, the operation setting the continuous paper P on the paper passing route of the printer 1 can be facilitated.

Figure 10:
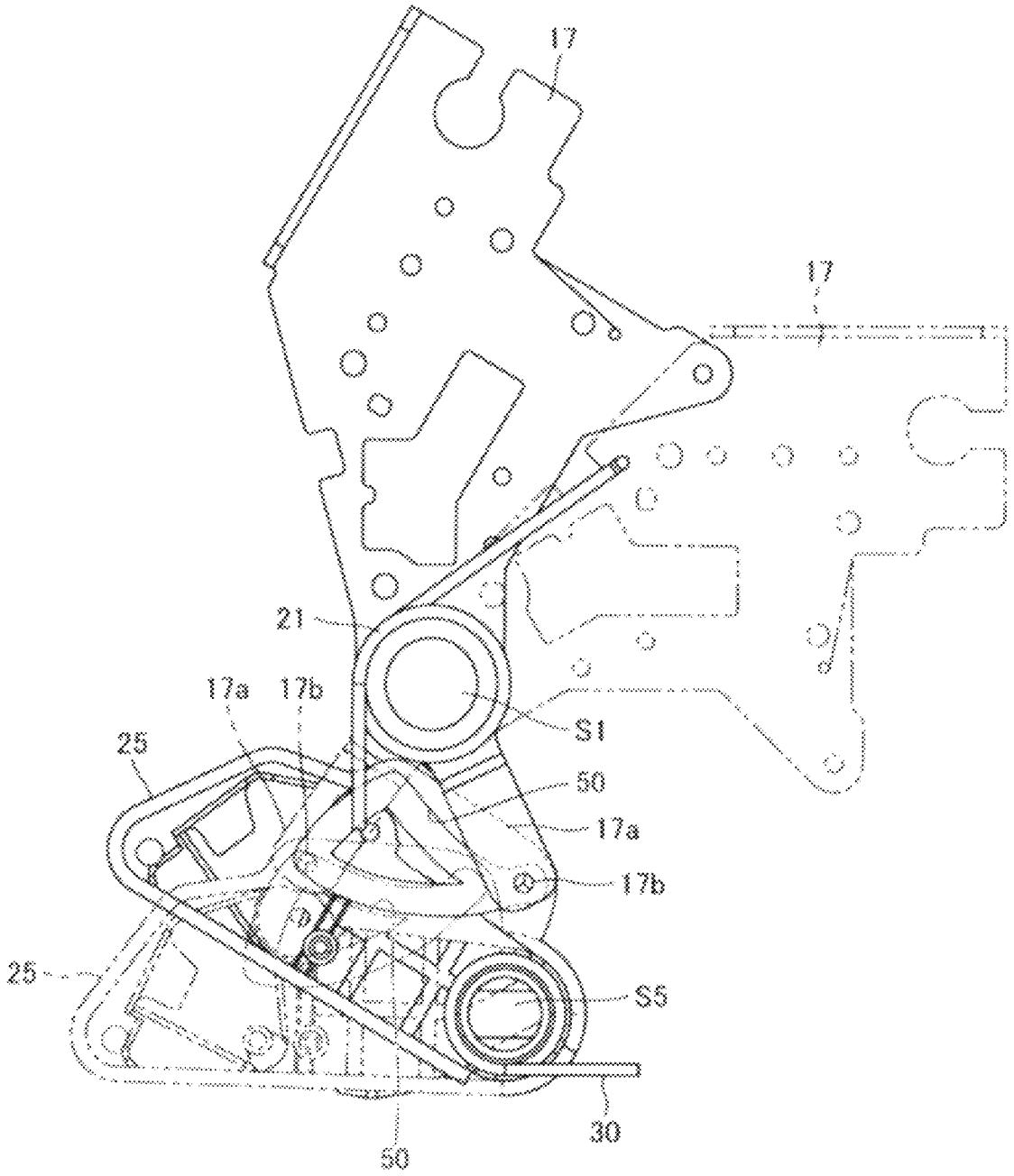
FIG. 10 is a side view illustrating extracted head supporting portion and damper supporting member on the open/closed position of the printing head portion.

Next, a coupled mechanism of the printing head portion 13 and the damper portion 15 will be described with reference to FIG. 8 to FIG. 11. FIG. 10 is a side view illustrating extracted head supporting portion and damper supporting member on opening/closing the printing head portion.

Figure 11:
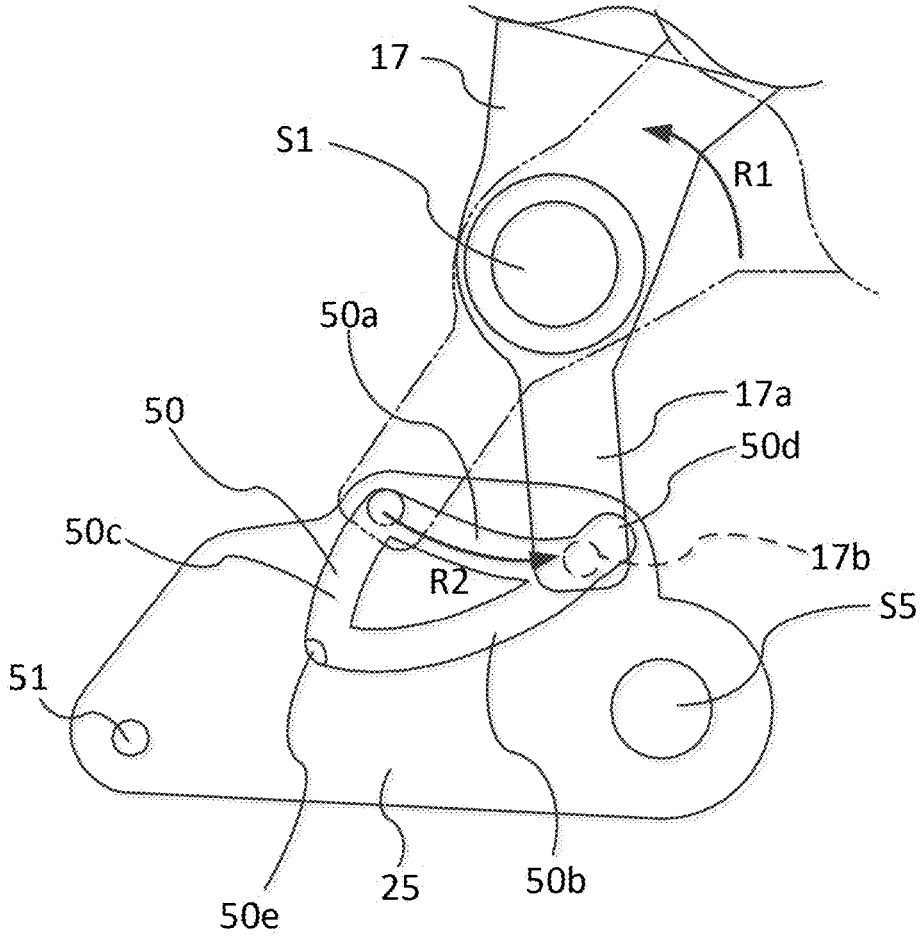
FIG. 11 is a side view of the head supporting portion and the damper supporting member in the middle of moving of the printing head portion in FIG. 10 to the open position.
Figure 12:
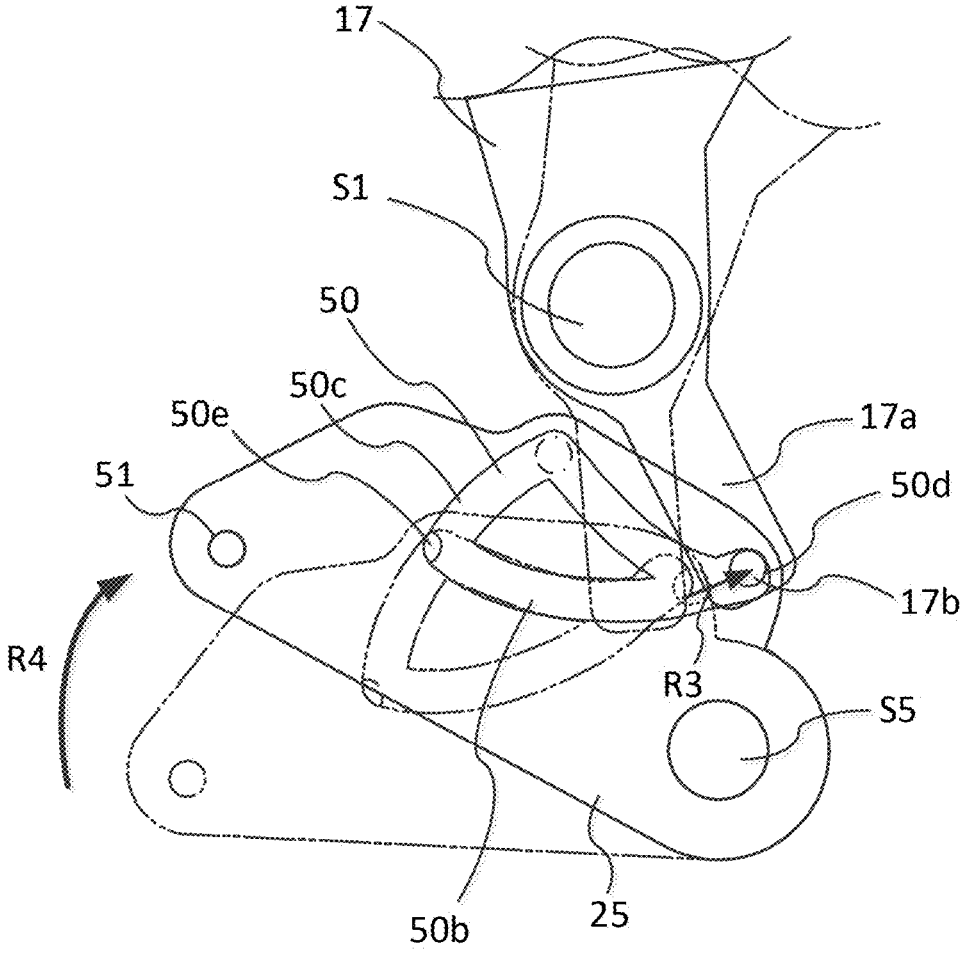
FIG. 12 is a side view of the head supporting portion and the damper supporting member after moving of the printing head portion in FIG. 10 to the open position.
Figure 13:
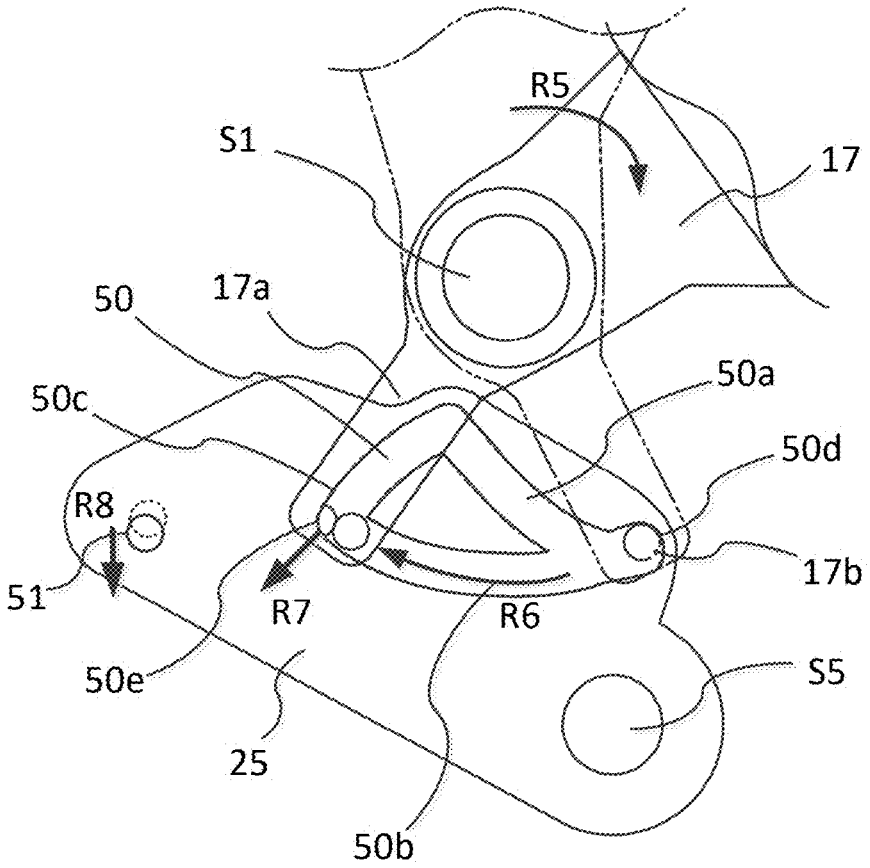
FIG. 13 is a side view of the head supporting portion and the damper supporting member when the printing head portion in FIG. 10 has moved from the open position to the closed position.
Figure 14:
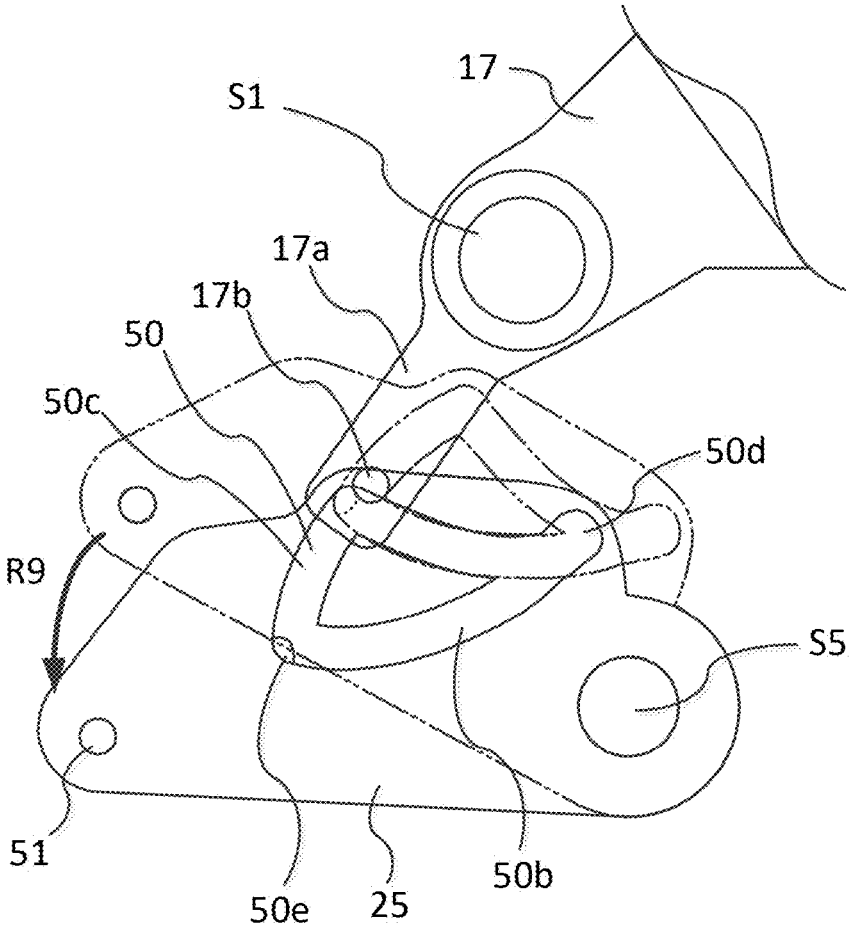
FIG. 14 is a side view of the head supporting portion and the damper supporting member when the printing head portion in FIG. 10 has moved from the open position to the closed position.

FIG. 11 is a side view of the head supporting portion and the damper supporting member in the middle of moving of the printing head portion in FIG. 10 to the open position. FIG. 12 is a side view of the head supporting portion and the damper supporting member after moving of the printing head portion in FIG. 10 to the open position. FIG. 13 is a side view of the head supporting portion and the damper supporting member when the printing head portion in FIG. 10 has moved from the open position to the closed position. FIG. 14 is a side view of the head supporting portion and the damper supporting member when the printing head portion in FIG. 10 has moved from the open position to the closed position.

It should be noted that, in FIG. 10, a two-dot chain line illustrates the head supporting portion 17 (a first support body) and the damper supporting member 25 (a second support body) positioned on the closed position. FIG. 10 to FIG. 14 illustrate the side surface of the printing unit 11 illustrated in FIG. 5.

The printer 1 according to the embodiment is a printer that performs printing on the long strip-shaped continuous paper P, and includes the platen roller portion 23 (not illustrated in FIG. 10 to FIG. 14) that feeds the continuous paper P, the printing head portion 13 disposed movable to the closed position opposing the platen roller portion 23 and the open position separated from the platen roller portion 23 and performing printing on the continuous paper P, and the damper portion 15 disposed on the upstream side in the feed direction of the continuous paper P of the printing head portion 13 so as to be movable to the closed position abutting on the continuous paper P and the open position separated from the continuous paper P to reduce the stress applied to the continuous paper P.

With the printer 1 according to the embodiment, in the case of the transition from a state where the printing head portion 13 is positioned on the closed position opposing the platen roller portion 23 and the damper portion 15 is positioned on the closed position abutting on the continuous paper P to a state where the printing head portion 13 is positioned on the open position separated from the platen roller portion 23 and the damper portion 15 is positioned on the open position separated from the continuous paper P, moving the printing head portion 13 to the open position causes the damper portion 15 to move to the open position in conjunction with the printing head portion 13.

With the printer 1 according to the embodiment, in the case of the transition from the state where the printing head portion 13 is positioned on the open position separated from the platen roller portion 23 and the damper portion 15 is positioned on the open position separated from the continuous paper P to the state where the printing head portion 13 is positioned on the closed position opposing the platen roller portion 23 and the damper portion 15 is positioned on the closed position abutting on the continuous paper P, the damper portion 15 moves to the closed position after the printing head portion 13 moved to the closed position.

First, the head supporting portion 17 will be described.

In this embodiment, the head supporting portion 17 that supports the printing head portion 13 includes the rocking shaft (corresponding to the printing head portion support shaft) S1 swingably supported inside the printer 1. The head supporting portion 17 includes the restricting portion 17*a* (corresponding to an engaging end portion) integrally formed on the upstream side in the feed direction with respect to the rocking shaft S1, and the restricting portion 17*a* has an engaging portion for engaging with a specific portion of the damper portion 15.

The restricting portion 17*a* includes a pin 17*b* projecting toward the damper portion 15 and disposed on a surface facing the damper portion 15. In the embodiment, the pin 17*b* corresponds to the engaging portion for engaging the damper portion 15 with the specific portion (see FIG. 7). The restricting portion 17*a* and the pin 17*b* constitute a mechanism that opens and closes the damper portion 15 in conjunction with the opening and closing operations of the printing head portion 13. These opening and closing operations will be described later.

With the above-described configuration, the printing head portion 13 is supported by the head supporting portion 17 on the one side surface of the printing head portion 13 in a state where the front portion of the printing head portion 13 is swingable in the up-and-down direction around the rocking shaft S1 (see FIG. 5 and FIG. 7) on the rear side (that is, in a state of being openable/closable).

Next, the damper supporting member 25 will be described on the basis of FIG. 11.

The damper supporting member 25 has a rocking shaft (corresponding to a damper support shaft) S5 swingably supported to the inside of the printer 1. The damper supporting member 25 includes a groove portion 50 with which the pin 17*b* formed on the restricting portion 17*a* engages.

The groove portion 50 includes a first groove 50*a*, a second groove 50*b*, and a third groove 50*c* which are mutually communicated to form an approximately triangular shape having each groove as one side.

The first groove 50*a* is formed on the printing head portion 13 side (upper portion side) of the damper supporting member 25, and formed along a moving trajectory of the pin 17*b* that moves when the head supporting portion 17 swings around the rocking shaft S1 in a state where the damper portion 15 is positioned on the closed position abutting on the continuous paper P.

The first groove 50*a* has an end portion formed so as to be positioned on the upstream side in the feed direction with respect to the center of the rocking shaft S5 of the damper supporting member 25 in a state where the head supporting portion 17 is positioned on the closed position.

The second groove 50*b* is formed along the moving trajectory of the pin 17*b* that moves when the head supporting portion 17 swings around the rocking shaft S1 in a state where the damper portion 15 is positioned on the open position separated from the bottom surface inside the printer 1, and formed to be connected to an end portion side of the first groove 50*a* on a downstream side in the feed direction having a route different from the first groove 50*a*. The second groove 50*b* has a terminating end portion (a joining portion to the third groove 50*c* described later) as an end portion opposite to the end portion connected to the first groove 50*a*, and a convex portion 50*e* is formed on the terminating end portion.

The third groove 50*c* is formed in a partial arc shape having the rocking shaft S5 as the center and a distance to the pin 17*b* as a radius in a state where the head supporting portion 17 is positioned on the closed position. The third groove 50*c* connects the end portion side of the first groove 50*a* on the upstream side in the feed direction to the end portion side of the second groove 50*b* on the upstream side in the feed direction.

The damper supporting member 25 includes a ball plunger 51 on the end portion on the upstream side in the feed direction where the rocking shaft S5 is disposed, and the ball plunger 51 is disposed as a locking member that locks the damper portion 15 in a state of being positioned on the open position.

While the illustration is omitted, the printer 1 internally includes a ball button on a predetermined position to lock the ball plunger 51. Locking the ball plunger 51 to the ball button locks the damper supporting member 25 to the open position.

The damper portion 15 includes a torsion spring 30 on the rocking shaft S5 as a biasing member that biases the damper portion 15 in a direction toward the closed position having the rocking shaft S5 as the rocking shaft.

The damper supporting member 25 is biased in a direction where the rear portion of the damper supporting member 25 moves downward from the open position to the closed position, that is, a direction where the entire damper portion 15 approaches the bottom surface inside the printer 1, by the torsion spring 30 having the rocking shaft S5 as the swing center. Then, the damper supporting member 25 is supported to the inside of the printer 1 in a state where the rear portion is swingable in the up-and-down direction around the rocking shaft S5. On the third groove 50*c*, since the pin 17*b* of the head supporting portion 17 is positioned inside the third groove 50*c* on the swing behavior of the damper supporting member 25 in a state where the head supporting portion 17 is positioned on the closed position, the pin 17*b* does not prevent the damper supporting member 25 from swinging. It should be noted that the rear portion of the damper supporting member 25 corresponds to the left sides in FIG. 10 to FIG. 13.

With the above-described configuration, the head supporting portion 17 and the damper supporting member 25 move to the open position as follows.

When the head supporting portion 17 moves from the closed position to the open position, the head supporting portion 17 swings in a direction of an arrow R1 having the rocking shaft S1 as the swing center. This is a case where the head supporting portion 17 moves from a position indicated by a two-dot chain line to a position indicated by a solid line in FIG. 11. At this time, the pin 17*b* moves to an end portion 50*d* of the first groove 50*a* along the first groove 50*a* in a direction of an arrow R2 illustrated in FIG. 11.

Since the damper supporting member 25 is biased toward the closed position by the torsion spring 30, the damper supporting member is maintained on the closed position when the head supporting portion 17 moves from the closed position to the open position.

When the head supporting portion 17 further continues to swing in the direction of the arrow R1 after the pin 17*b* abuts on the end portion 50*d* of the first groove 50*a*, as illustrated in FIG. 12, the pin 17*b* presses the end portion 50*d* inside the first groove 50*a* to the downstream side in the feed direction (an arrow R3 direction), and the pin 17*b* moves to a position on the downstream side in the feed direction (right side in FIG. 12) with respect to the center of the rocking shaft S5.

At this time, a force against the biasing force of the torsion spring 30 is applied to the damper supporting member 25, and the damper supporting member 25 swings in a direction of an arrow R4 having the rocking shaft S5 as the swing center. Furthermore, the damper supporting member 25 continues swinging to be positioned on the open position. At this time, the ball plunger 51 is locked to a ball button (not illustrated) inside the printer 1 to hold the damper supporting member 25 on the open position without returning to the closed position by the biasing force of the torsion spring 30.

Thus, the head supporting portion 17 and the damper supporting member 25 coordinate to move to the open position, and the head supporting portion 17 and the damper supporting member 25 are locked on the open position.

Next, a description will be given of the moving operation of the head supporting portion 17 and the damper supporting member 25 to the closed position.

When the head supporting portion 17 moves from the open position to the closed position, the head supporting portion 17 swings in a direction of an arrow R5 having the rocking shaft S1 as the swing center. This is a case where the head supporting portion 17 moves from a position indicated by a two-dot chain line to a position indicated by a solid line in FIG. 13. At this time, the pin 17*b* moves in a direction of an arrow R6 illustrated in FIG. 11 along the second groove 50*b*.

When the head supporting portion 17 further continues to swing in the direction of the arrow R5 to reach the closed position after the pin 17*b* abuts on the convex portion 50*e* formed on the end portion of the second groove 50*b*, as illustrated in FIG. 13, the convex portion 50*e* is pressed by the pin 17*b* in a direction of an arrow R7.

Then, the lock of the ball plunger 51 to the lock position (not illustrated) (indicated by a dotted line in FIG. 13) is released, and the end portion of the damper supporting member 25, where the ball plunger 51 is disposed, moves down in a direction of an arrow R8.

As illustrated in FIG. 14, when the ball plunger 51 is released from the predetermined position inside the printer 1, the damper supporting member 25 swings in a direction of an arrow R9 due to the downward biasing force of the torsion spring 30 disposed on the rocking shaft S5, and the damper supporting member 25 moves to the closed position.

Thus, when the head supporting portion 17 and the damper supporting member 25 move to the closed position, the head supporting portion 17 moves to the closed position, and subsequently, the damper supporting member 25 moves to the closed position.

With the above-described configuration, when the printing head portion 13 moves to the open position, the pin 17*b* of the restricting portion 17*a* moves to the end portion 50*d* of the first groove 50*a*, and the rear portion of the damper supporting member 25 is lifted. This causes the rear portion of the damper portion 15 to open in conjunction with the opening operation of the printing head portion 13.

On the other hand, when the printing head portion 13 moves to the closed position, the ball plunger 51 that locks the damper supporting member 25 to the printer 1 is released after the head supporting portion 17 moved to the closed position. This causes the damper supporting member 25 moves to the closed position due to the biasing force of the torsion spring 30.

As described above, according to the embodiment, the damper portion 15 moves to the closed position after the printing head portion 13 moved to the closed position. Then, the continuous paper P is pressed by the printing head portion 13 in the direction of the bottom surface of the printer 1 prior to the damper portion 15. That is, a printing start position of the continuous paper P is pressed at a position matching a corresponding position of the printing head portion 13. Therefore, when the damper portion 15 moves to the closed position, the positional displacement of the printing start position caused by the damper portion 15 pulling the continuous paper P does not occur.

The opening and closing mechanism of the printing head portion 13 and the damper portion 15 is not limited to the above-described configuration. For example, the damper supporting member 25 may include a ball button and the printer 1 may internally include a ball plunger.

Figure 15:
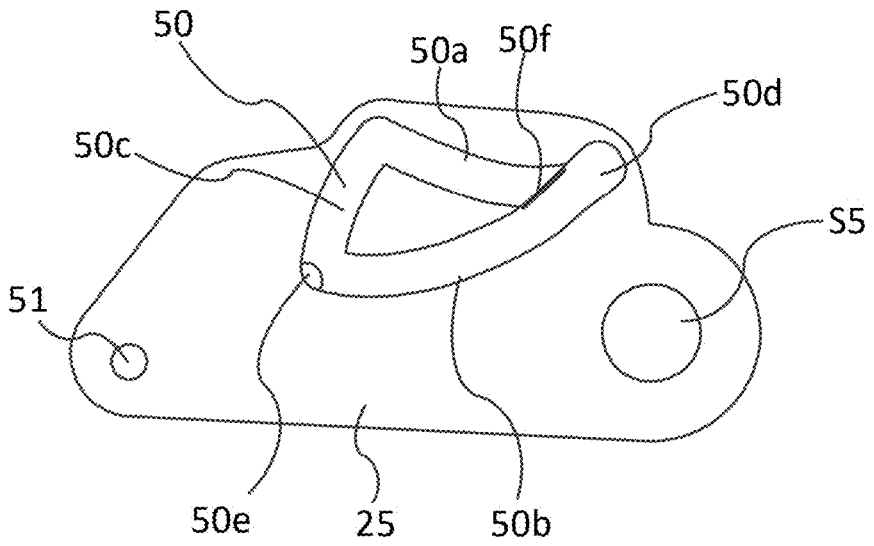
FIG. 15 is a side view describing another embodiment of the head supporting portion.

Another embodiment of the damper supporting member 25 will be described. FIG. 15 is a side view describing the other embodiment of the head supporting portion.

As illustrated in FIG. 15, a step 50*f* may be formed between the first groove 50*a* and the second groove 50*b*. In this case, when the printing head portion 13 moves from the open position to the closed position, the step 50*f* prevents the pin 17*b* from moving in a direction entering from the second groove 50*b* to the first groove 50*a*. Then, when the printing head portion 13 moves from the open position to the closed position, a malfunction such that the pin 17*b* enters the first groove 50*a* to close the damper portion 15 with the closing operation of the printing head portion 13 can be prevented.

Figure 16:
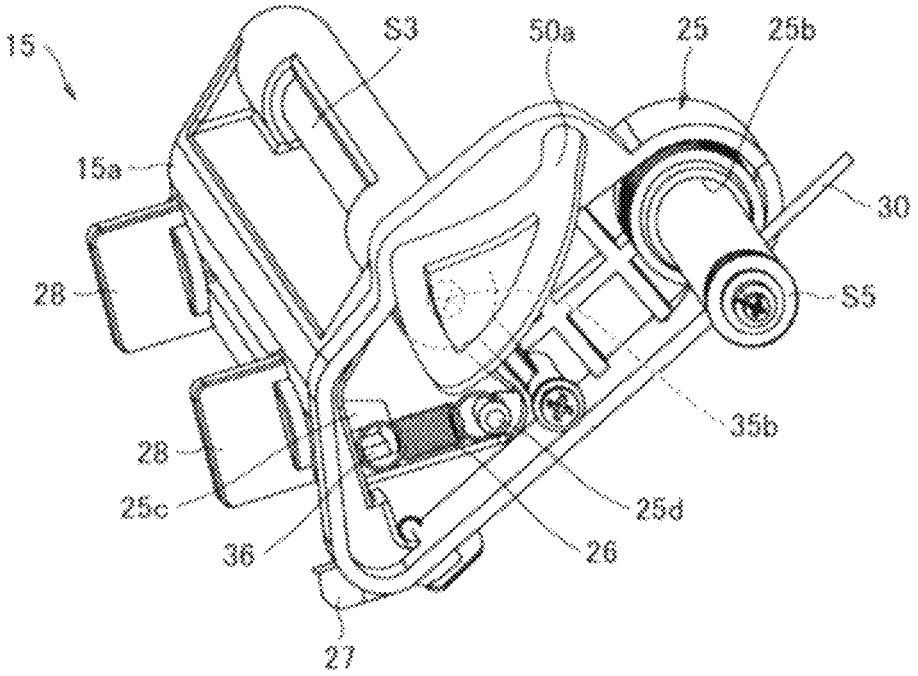
FIG. 16 is a perspective view of the damper portion and the damper supporting member viewed from a side surface side of the printing unit in FIG. 5.
Figure 17:
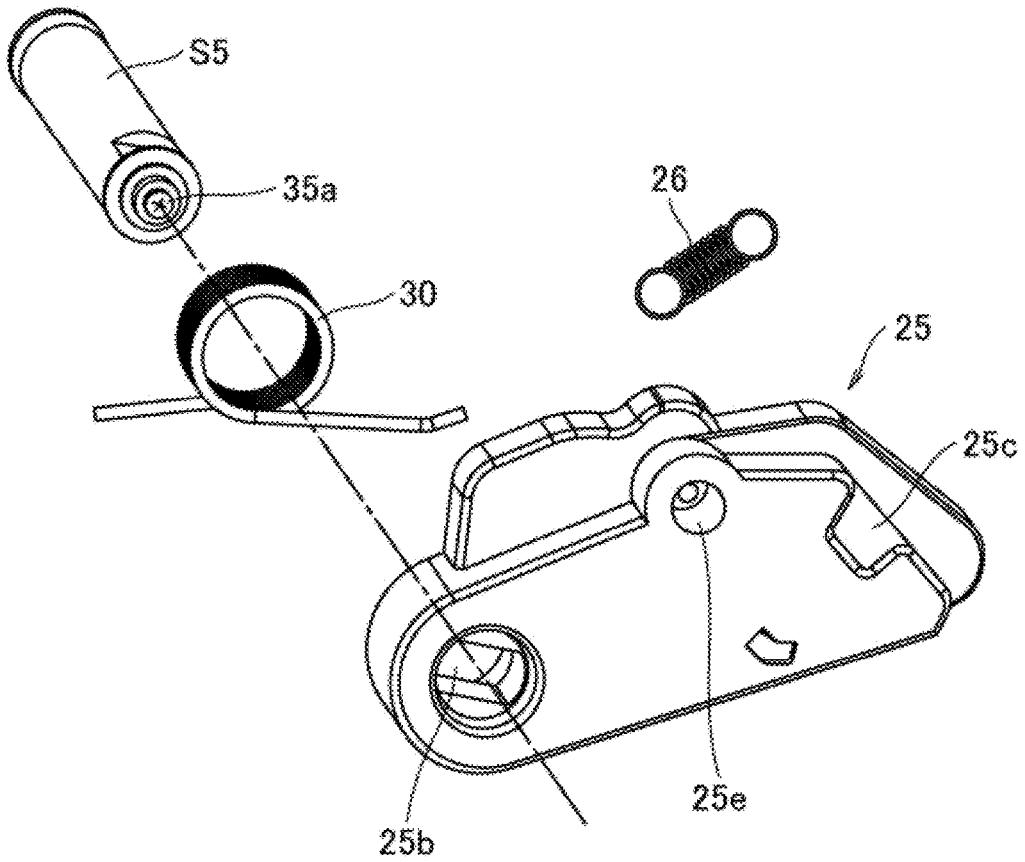
FIG. 17 is an exploded perspective view of the damper supporting member viewed from a side where the damper portion is mounted.
Figure 18A:
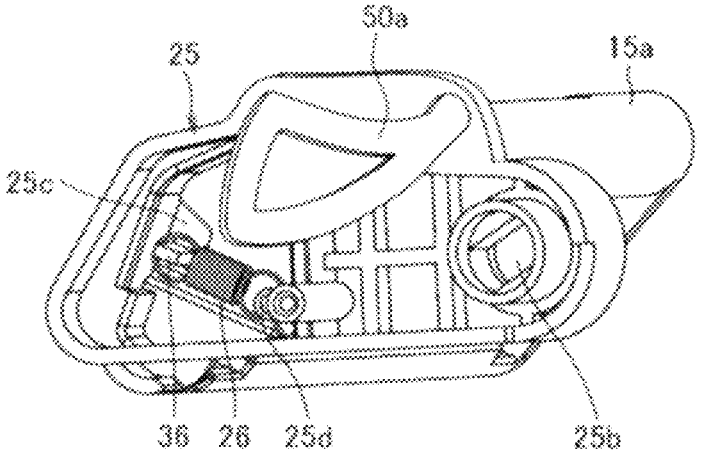
FIG. 18A is a perspective view illustrating a coupling portion of an outer damper portion and the damper supporting member in FIG. 16.
Figure 18B:
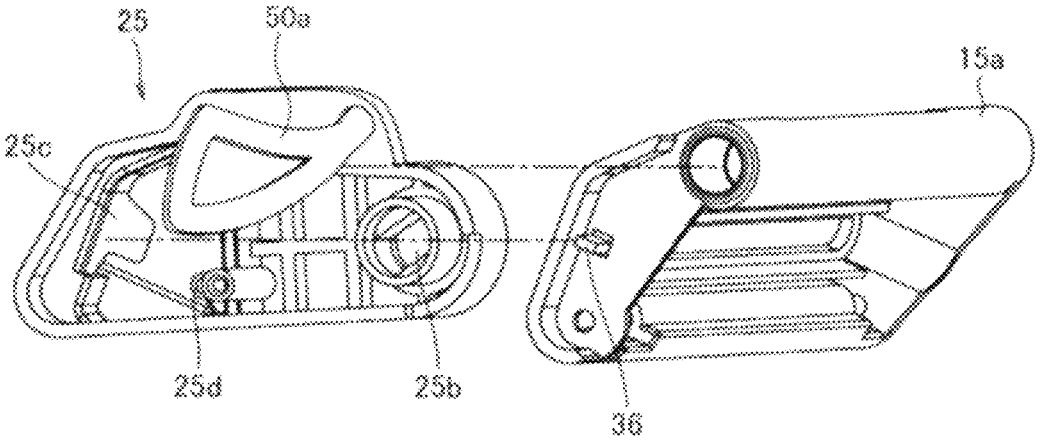
FIG. 18B is an exploded perspective view illustrating a positional relationship to couple the outer damper portion to the damper supporting member in FIG. 18A.

Next, a configuration of the damper supporting member 25 and a coupling relationship with the damper portion 15 and the damper supporting member 25 will be described with reference to FIG. 16 to FIG. 18A and FIG. 18B. FIG. 16 is a perspective view of the damper portion and the damper supporting member viewed from a side surface side of the printing unit in FIG. 5. FIG. 17 is an exploded perspective view of the damper supporting member viewed from a side where the damper portion is mounted. FIG. 18A is a perspective view for illustrating a coupling portion of the outer damper portion and the damper supporting member in FIG. 16. FIG. 18B is an exploded perspective view for illustrating a positional relationship to couple the outer damper portion to the damper supporting member in FIG. 18A. It should be noted that, on both side surfaces of the damper supporting member 25, a side surface facing the outer damper portion 15*a* is referred to as an internal surface, and a side surface of its back side is referred to as an outer surface.

On one end side in the longitudinal direction of the damper supporting member 25, a bearing hole portion 25*b*, which passes through both side surfaces of the damper supporting member 25, is formed. Into this bearing hole portion 25*b*, the rocking shaft S5 is inserted in a fixed state not to swing, and screwed by a screw 35*a* (see FIG. 17) not to remove. It should be noted that the torsion spring 30 is mounted in a state where its ring is fitted to the rocking shaft S5.

On the other end side in the longitudinal direction of the damper supporting member 25, a hole portion 25*c*, which passes through between both side surfaces of the damper supporting member 25, is formed. A protrusion 36 formed on a side surface of the outer damper portion 15*a* projects from the hole portion 25*c*. The hole portion 25*c* is formed such that a margin at predetermined dimensions is generated around the protrusion 36.

The outer surface of the damper supporting member 25 is formed to be depressed in a thickness direction. On this outer surface of the damper supporting member 25, at a proximity of the hole portion 25*c*, a protrusion 25*d* is formed. Between this protrusion 25*d* of the damper supporting member 25 and the protrusion 36 of the outer damper portion 15*a*, the coil spring 26 is installed to be bridged. This coil spring 26 is biased to pull the protrusion 36 of the outer damper portion 15*a* in a direction of the protrusion 25*d* of the damper supporting member 25. Thus, the outer damper portion 15*a*, while being firmly supported along an axial direction of the rocking shaft S3 and suppressed not to go excessively to an upper side, is swingably supported so as to reduce a stress applied to the continuous paper P.

Furthermore, on an upper portion of the internal surface of the damper supporting member 25, at a proximity of a center in a longitudinal direction, a bearing hole portion 25*e* (see FIG. 17) is formed. Into this bearing hole portion 25*e*, the rocking shaft S3 of the outer damper portion 15*a* is inserted in a fixed state not to swing, and screwed by a screw 35*b* (see FIG. 16) not to remove.

Figure 19A:
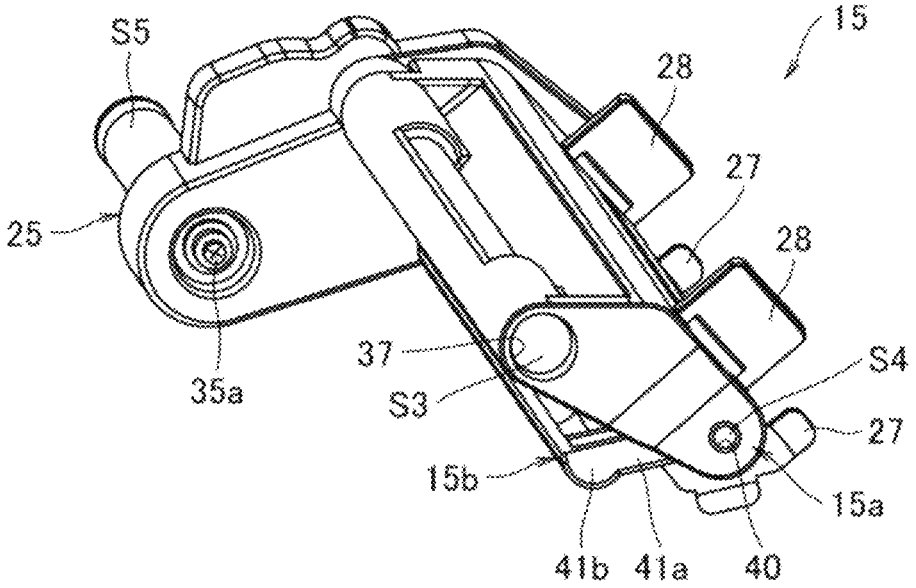
FIG. 19A is a perspective view of the damper portion and the damper supporting member viewed from an oblique upper side.
Figure 19B:
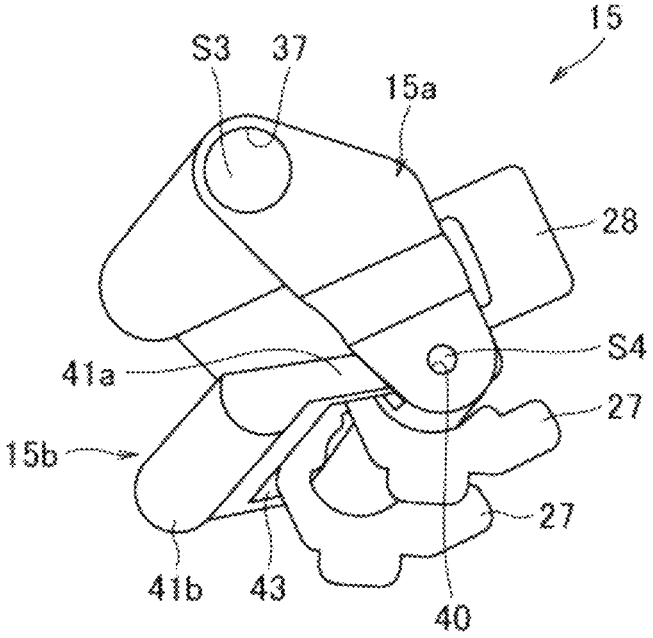
FIG. 19B is a perspective view of the damper portion viewed from an oblique lower side.
Figure 20:
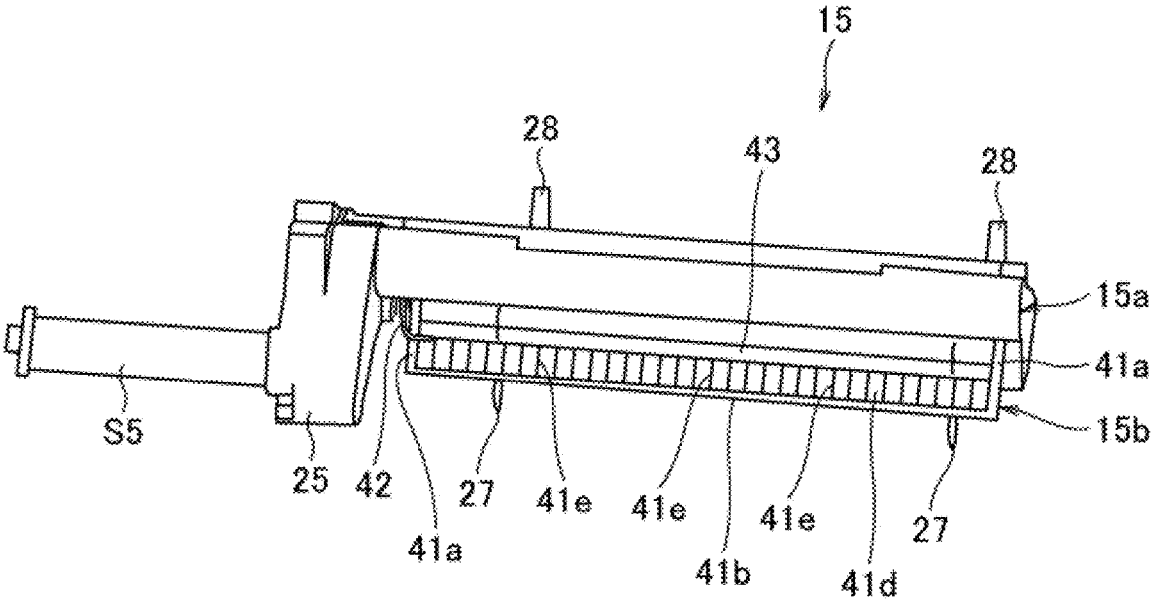
FIG. 20 is a perspective view of the damper portion and the damper supporting member viewed from an upper side.
Figure 21:
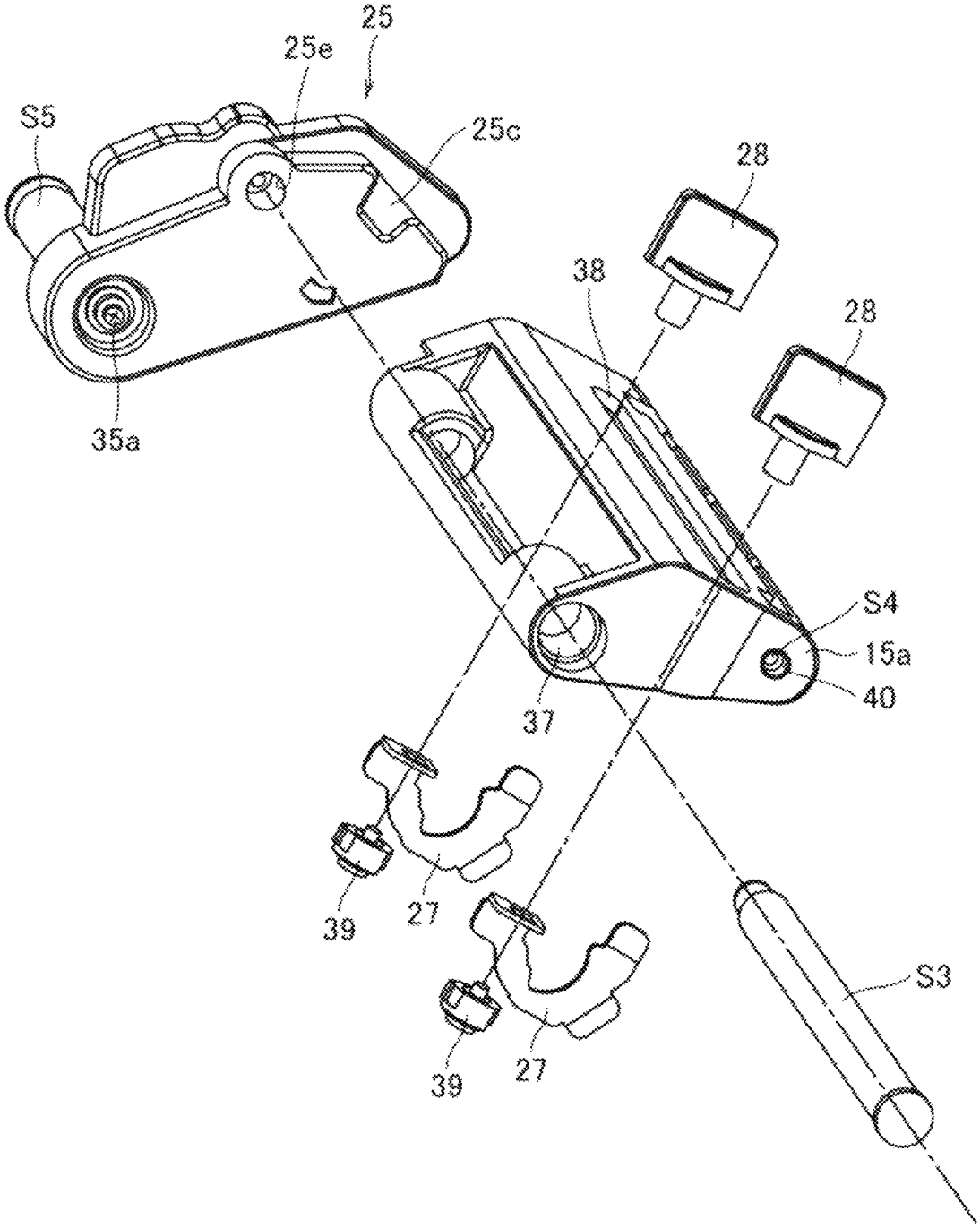
FIG. 21 is an exploded perspective view of the outer damper portion.
Figure 22:
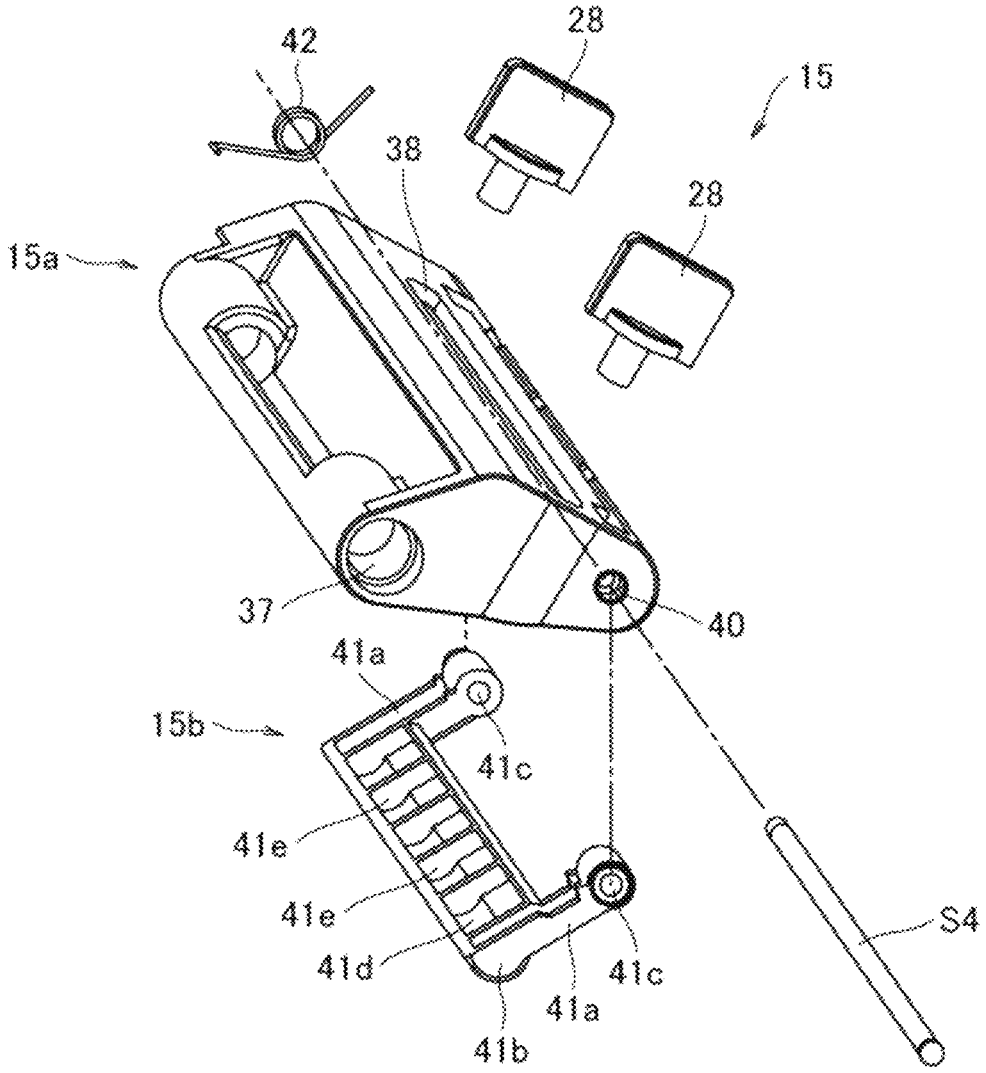
FIG. 22 is an exploded perspective view of the outer damper portion and an inner damper portion.

Next, a configuration of the damper portion 15 will be described with reference to FIG. 19A and FIG. 19B to FIG. 22. FIG. 19A is a perspective view of the damper portion and the damper supporting member viewed from an oblique upper side. FIG. 19B is a perspective view of the damper portion viewed from an oblique lower side. FIG. 20 is a perspective view of the damper portion and the damper supporting member viewed from an upper side. FIG. 21 is an exploded perspective view of the outer damper portion. FIG. 22 is an exploded perspective view of the outer damper portion and the inner damper portion.

On one end side (upper end portion side) in the longitudinal direction where the outer damper portion 15*a* is viewed from the side surface, a bearing hole portion 37 is formed. Into this bearing hole portion 37, the rocking shaft S3 is inserted. Thus, the outer damper portion 15*a* is swingably journaled around the rocking shaft S3. That is, the outer damper portion 15*a* is swingably journaled in the up-and-down direction such that its other end part (lower end portion) in the longitudinal direction can reduce the stress applied to the continuous paper P around the rocking shaft S3.

On a surface of the outer damper portion 15*a* on the back side of the printer 1, a slide hole portion 38 is formed along the axial direction of the rocking shaft S3. Into this slide hole portion 38, shaft portions of two guide operating portions 28 are inserted. To this shaft portion of the guide operating portion 28, the width adjustment guiding portion 27 is coupled by a pin 39 (see FIG. 19A and FIG. 19B). Here, for example, the guide operating portion 28 on a far-side is fixed. The guide operating portion 28 on a near-side, while being movable along the slide hole portion 38, can be fixed according to the width of the continuous paper P. It should be noted that the width adjustment guiding portion 27 and the guide operating portion 28 will be described later in detail.

The paper sheet contact portion, where the continuous paper P contacts on the end portion side on the upstream side in the feed direction when the outer damper portion 15*a* is viewed from the side surface, is formed in the arc-shape where the outer damper portion 15*a* is viewed from the side surface side. This can decrease contact resistance of the outer damper portion 15*a* and the continuous paper P to make a flow of the continuous paper P smooth.

On the end portion side of the outer damper portion 15*a* on the upstream side in the feed direction, a bearing hole portion 40 is formed. Into this bearing hole portion 40, the rocking shaft S4 is inserted in a fixed state not to swing. The rocking shaft S4 is disposed parallel to the rocking shaft S3. To this rocking shaft S4, the inner damper portion 15*b* is journaled.

The inner damper portion 15*b* includes supporting portions 41*a*, 41*a* at two sites and a main body portion 41*b*, which is integrally formed on one end sides of them to bridge them. On one ends of the supporting portions 41*a*, 41*a*, a bearing hole portion 41*c* is formed each. Into these bearing hole portions 41*c*, 41*c*, the rocking shaft S4 is inserted. Thus, the inner damper portion 15*b* is swingably journaled around the rocking shaft S4.

On one end side of the rocking shaft S4, a torsion spring 42 (see FIG. 20 and FIG. 22) is mounted in a state being engaged with the inner damper portion 15*b*. By biasing force of this torsion spring 42, the inner damper portion 15*b* is journaled to the rocking shaft S4 in a swingable state in the up-and-down direction such that the lower end portion (paper sheet contact portion) of the inner damper portion 15*b* can reduce the stress acting on the continuous paper P.

On the other hand, a paper sheet contact portion side, where the continuous paper P contacts, on the main body portion 41*b* of the inner damper portion 15*b* is formed in the arc-shape where the inner damper portion 15*b* is viewed from the side surface. This can decrease contact resistance of the inner damper portion 15*b* and the continuous paper P to make the flow of the continuous paper P smooth.

On an opposite surface side of the paper sheet contact portion on the main body portion 41*b*, a depression portion 41*d* is formed. Within this depression portion 41*d*, a plurality of reinforcing plates 41*e* are disposed along the axial direction of the rocking shaft S4 at every predetermined interval. This, while ensuring strength of the inner damper portion 15*b*, can save weight of the inner damper portion 15*b*.

Although disposing a damper function completely separately is considered, in this case, due to the limited space near the damper portion 15, the printer 1 is enlarged in some cases. In contrast, according to the embodiment, as the inner damper portion 15*b* is journaled to the outer damper portion 15*a*, without enlarging the printer 1, even in the case of the inside wound label, the damper function, which can fully reduce the stress acting on the continuous paper P, can be added.

Furthermore, according to the embodiment, the outer damper portion 15*a* and the inner damper portion 15*b* as described above, for example, are constituted of a transparent resin. This can improve visibility of the continuous paper P at the damper portion 15 to more facilitate the operation setting the continuous paper P on the paper passing route of the printer 1. That is, the position of the non-transparent width adjustment guiding portion 27 is confirmed through the transparent damper portion, thus ensuring the easy position adjustment. From such aspect, transparent means that an opposite side of the member is viewable, and transparent material includes colored translucent material and uncolored translucent material as well as uncolored material.

It should be noted that between the main body portion 41*b* of the inner damper portion 15*b* and the outer damper portion 15*a*, a gap 43 (see FIG. 19B and FIG. 20) is formed not to obstruct a move of the width adjustment guiding portion 27.

Next, an operational advantage by the damper portion 15 will be described with reference to FIG. 23A, FIG. 23B to FIG. 25A, and FIG. 25B.

Figure 23A:
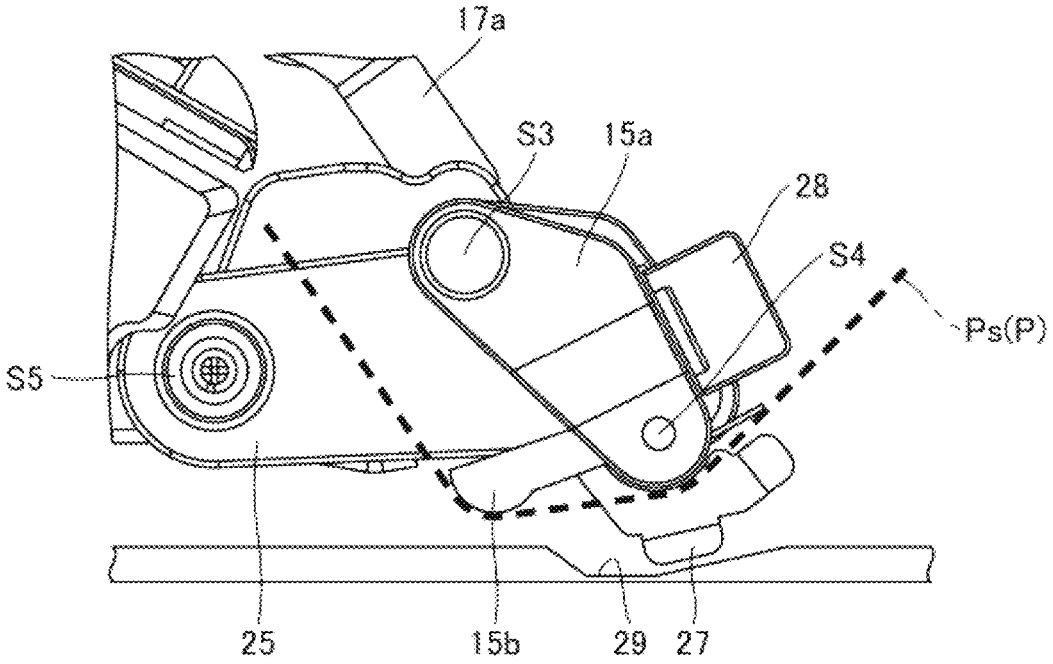
FIG. 23A is an enlarged side view of the damper portion when a continuous paper of an outside wound label is set.
Figure 23B:
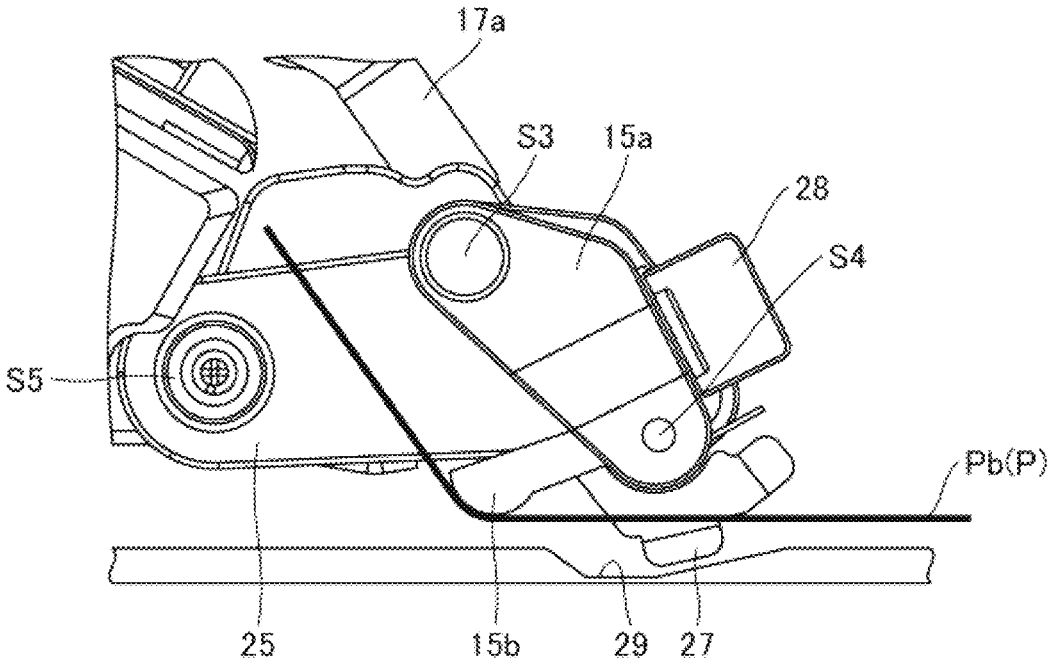
FIG. 23B is an enlarged side view of the damper portion when a continuous paper of an inside wound label is set.

FIG. 23A is an enlarged side view of the damper portion when the continuous paper of the outside wound label is set. FIG. 23B is an enlarged side view of the damper portion when the continuous paper of the inside wound label is set.

As illustrated in FIG. 23A, in the case of the outside wound label, because the continuous paper Ps is unwound from around the center in the height direction of the paper sheet supply unit 10 to be passed through below the damper portion 15, the continuous paper Ps is set on the paper passing route in a state contacting both outer damper portion 15*a* and inner damper portion 15*b*. In view of this, the stress acting on the continuous paper Ps can be fully reduced to feed the continuous paper Ps properly and ensure the printing quality.

On the other hand, in the case of the inside wound label, especially in the case where the inside wound label has a large diameter, because the continuous paper P is unwound from around the bottom surface inside the printer 1 to be passed through below the damper portion 15, in a case where only the outer damper portion 15*a* is disposed (case without the inner damper portion 15*b*), the stress acting on the continuous paper P set on the paper passing route is not fully reduced in some cases. In view of this, the continuous paper P fails to be fed correctly to deteriorate the printing quality in some cases.

In contrast, according to the embodiment, as illustrated in FIG. 23B, even if the paper passing route differs depending on the form of the label such as the inside wound label and the outside wound label, or depending on the size of the diameter of the rolled label, the continuous paper Pb is set on the paper passing route in a state of contacting at least the inner damper portion 15*b*, thus fully reducing the stress acting on the continuous paper Pb. Then, the continuous paper Pb can be properly fed to ensure the printing quality.

Figure 24A:
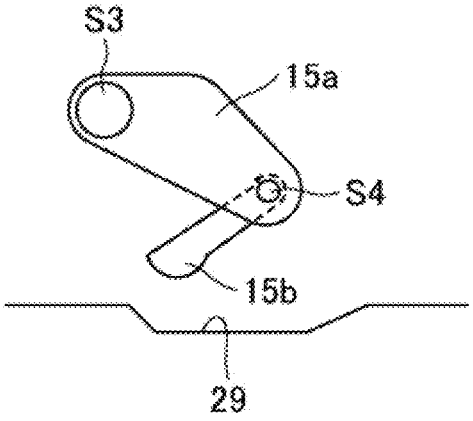
FIG. 24A is a side view of the damper portion at a phase before setting the continuous paper on a paper passing route.

FIG. 24A is a side view of the damper portion at a stage before setting the continuous paper on the paper passing route.

Figure 24B:
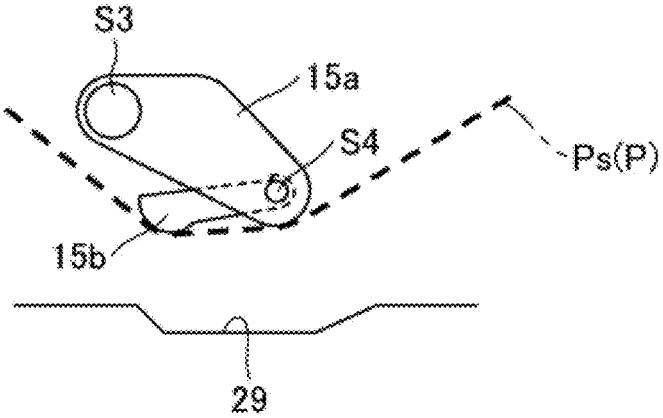
FIG. 24B is a side view of the damper portion in the case of the outside wound label at a phase where the rolled continuous paper in a paper sheet supply unit has decreased and an outer periphery portion of the rolled continuous paper has closed to a support shaft.

FIG. 24B illustrates an exemplary phase (the roll diameter is small) that, in the case of the outside wound label, the rolled continuous paper Ps of the paper sheet supply unit 10 has decreased, and an outer peripheral portion of the rolled continuous paper Ps has closed to the support shaft 10*a*. In this case, since a position where the continuous paper Ps is unwound becomes lower than a position at an early stage, although pressing force of the continuous paper Ps against the outer damper portion 15*a* is weakened, and a height of the outer damper portion 15*a* does not change, the inner damper portion 15*b* can rise to reduce an impact due to a force acting on the continuous paper Ps and pulling in an opposite direction of the feed direction.

Figure 24C:
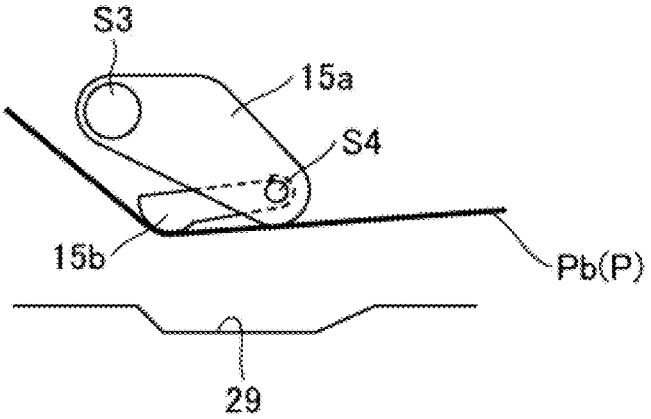
FIG. 24C is a side view of the damper portion in the case of the inside wound label at a phase where the rolled continuous paper in the paper sheet supply unit has started decreasing.

FIG. 24C illustrates an exemplary case of an early phase (the roll diameter is large) of the rolled continuous paper Pb of the paper sheet supply unit 10 in the case of the inside wound label. In this case, since a position where the continuous paper Pb is unwound becomes low (close to the bottom surface of the printer 1), although, while the continuous paper Pb contacts the outer damper portion 15*a*, the pressing force is low, and the height of the outer damper portion 15*a* does not change, the inner damper portion 15*b* can rise to reduce an impact due to a force acting on the continuous paper Pb and pulling in an opposite direction of the feed direction.

Figure 25A:
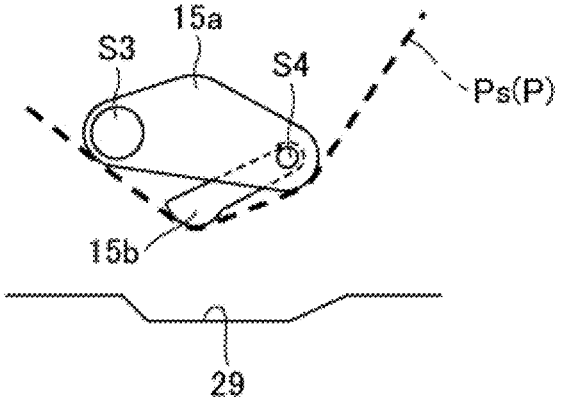
FIG. 25A is a side view of the damper portion in the case of the outside wound label at an early stage of the rolled continuous paper in the paper sheet supply unit.

FIG. 25A illustrates an exemplary case that, in the case of the outside wound label, the rolled continuous paper Ps of the paper sheet supply unit 10 is at the early stage (the roll diameter is large). In this case, since the position where the continuous paper Ps is unwound is high, both outer damper portion 15*a* and inner damper portion 15*b* can rise to reduce an impact due to a force acting on the continuous paper Ps and pulling in an opposite direction of the feed direction.

Figure 25B:
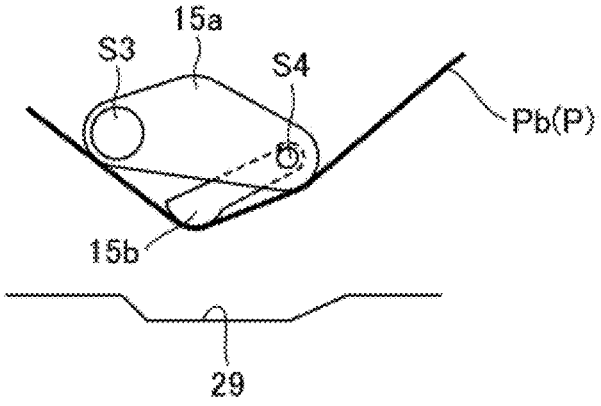
FIG. 25B is a side view of the damper portion in the case of the inside wound label at a phase where the rolled continuous paper in the paper sheet supply unit has decreased and an outer periphery portion of the rolled continuous paper has closed to the support shaft.

FIG. 25B illustrates an exemplary case (the roll diameter is small) that, in the case of the inside wound label, the rolled continuous paper Pb of the paper sheet supply unit 10 has decreased, and an outer periphery portion of the rolled continuous paper Pb has closed to the support shaft 10*a*. In this case, since the position where the continuous paper Pb is unwound becomes higher than the position at the early stage, both outer damper portion 15*a* and inner damper portion 15*b* can rise to reduce an impact due to a force acting on the continuous paper Pb and pulling in an opposite direction of the feed direction.

Figure 26:
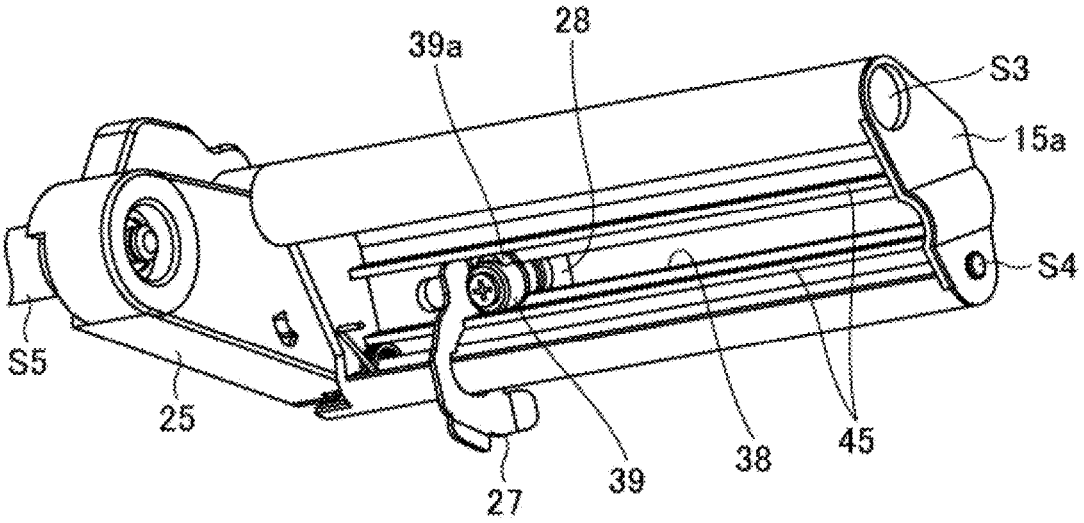
FIG. 26 is a perspective view of the outer damper portion viewed from a front side of the printer.
Figure 27:
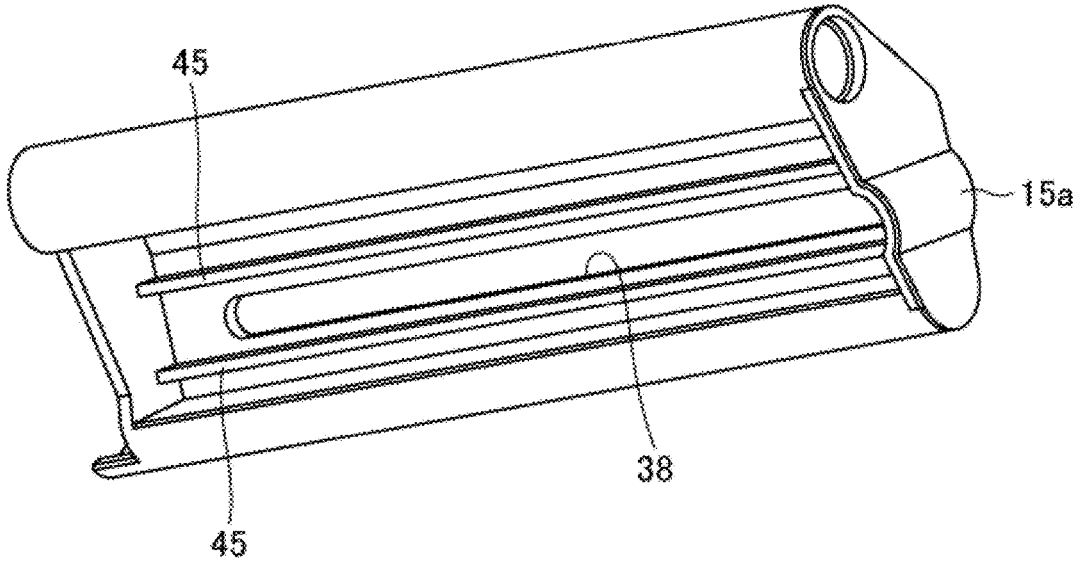
FIG. 27 is a perspective view illustrating the outer damper portion extracted from FIG. 26.
Figure 28:
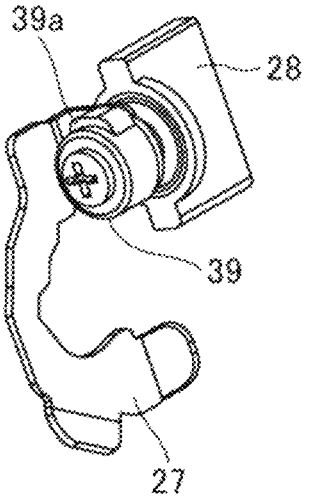
FIG. 28 is a perspective view illustrating a width adjustment guiding portion and a guide operating portion 28 extracted from FIG. 26.
Figure 29:
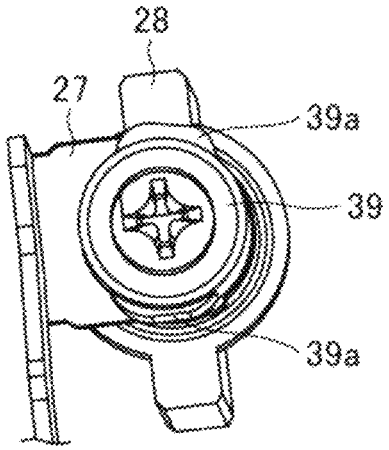
FIG. 29 is a perspective view illustrating a coupling portion of the width adjustment guiding portion and the guide operating portion.
Figure 30:
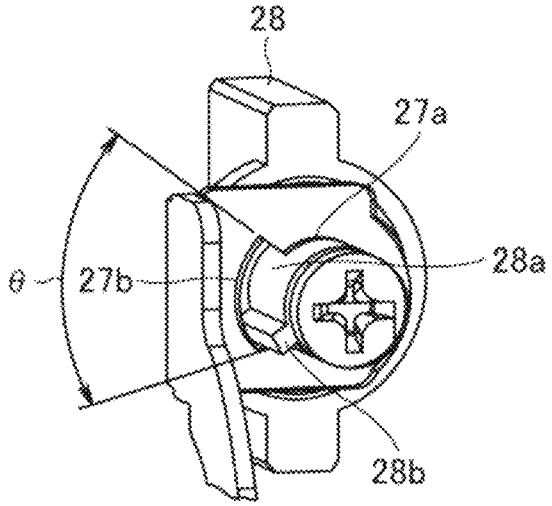
FIG. 30 is a perspective view of an engaging portion of a shaft portion of the guide operating portion and the width adjustment guiding portion.

Next, the width adjustment guiding portion 27 and the guide operating portion 28 will be described with reference to FIG. 26 to FIG. 30. FIG. 26 is a perspective view of the outer damper portion viewed from a front side of the printer 1. FIG. 27 is a perspective view for illustrating the outer damper portion extracted from FIG. 26. FIG. 28 is a perspective view for illustrating the width adjustment guiding portion and the guide operating portion 28 extracted from FIG. 26. FIG. 29 is a perspective view for illustrating a coupling portion of the width adjustment guiding portion and the guide operating portion. FIG. 30 is a perspective view of an engaging portion of a shaft portion of the guide operating portion and the width adjustment guiding portion. It should be noted that, in FIG. 30, in order to see a shaft portion 28*a* of the guide operating portion 28 easily, the pin 39 is omitted.

As illustrated in FIG. 26 and FIG. 27, inside the outer damper portion 15*a*, two guide rail portions 45 are formed, as sandwiching an upper and lower portions of the slide hole portion 38, in a state extending along the slide hole portion 38. The guide rail portion 45 is integrally shaped with the outer damper portion 15*a*, for example, is formed with transparent resin.

As illustrated in FIG. 28, the pin 39, which couples the width adjustment guiding portion 27 to the guide operating portion 28, is disposed at a position sandwiched between the two guide rail portions 45 of the outer damper portion 15*a*. The pin 39 includes an outer periphery where, as illustrated in FIG. 26, FIG. 28 and FIG. 29, two convex portions 39*a*, 39*a* are formed projecting in a radial direction. The convex portions 39*a*, 39*a* are formed at facing positions 180 degrees separated from each other.

If the guide operating portion 28 is held to swing around the shaft portion 28*a*, the pin 39 also swings. Then, the two convex portions 39*a*, 39*a* of the pin 39 are pressed to inner surfaces of the two guide rail portions 45 by a swing position of the pin 39. Thus, the guide rail portion 45 slacks, and the pin 39 abuts between the two guide rail portions 45 to be sandwiched, by which the pin 39 is fixed. Thus, the guide operating portion 28 is locked. On the other hand, if the guide operating portion 28 is swung further 90 degrees from a locked state, since the two convex portions 39*a*, 39*a* of the pin 39 separate from the two guide rail portions 45, the locked state of the guide operating portion 28 is released. Accordingly, with the embodiment, a position of the width adjustment guiding portion 27 can be set with a simple structure and a simple operation.

As illustrated in FIG. 30, the shaft portion 28*a* of the guide operating portion 28 includes an outer periphery, on which a convex portion 28*b* is formed. At the width adjustment guiding portion 27, on an outer periphery of a hole 27*a* where the shaft portion 28*a* of the guide operating portion 28 is inserted, a range setting hole 27*b* is formed in a state communicating with the hole 27*a*. The convex portion 28*b*, which is disposed within the range setting hole 27*b*, is configured to swing the guide operating portion 28 in a range of θ in a circumferential direction of the range setting hole 27*b*.

Next, a description will be given of the operational advantages of the depression portion 29 disposed on the bottom surface inside the printer 1 positioned below the width adjustment guiding portion 27 of the damper portion 15 with reference to FIG. 23A, FIG. 23B, and similar drawing.

In printing by the printer 1, the continuous paper P is fed from the paper sheet supply unit 10 side to the printing unit 11 side, that is, from the upstream side to the downstream side in the feed direction (referred to as a forward feed). On the other hand, for performing positioning of the printing start position, the continuous paper P is fed from the printing unit 11 side to the paper sheet supply unit 10 side, that is, from the downstream side to the upstream side in the feed direction (referred to as a back feed) in some cases.

In the case of the forward feed, as disclosed in FIG. 21 and similar drawing, the continuous paper P bridged over the paper sheet supply unit 10 and the printing unit 11 is arranged on a position apart from the bottom surface inside the printer 1. In this state, the tension is constantly applied to the continuous paper P.

However, in the case of the back feed, the continuous paper P loosens to contact the bottom surface inside the printer 1 at a position corresponding to the width adjustment guiding portion 27 on the bottom surface inside the printer 1 in some cases. At this time, provisionally, when the depression portion 29 is not disposed, the continuous paper P exceeds the lower end of the width adjustment guiding portion 27 from a gap between the width adjustment guiding portion 27 and the bottom surface inside the printer 1, and comes outside a guide region restricted by the width adjustment guiding portion 27. Then, in this state, returning to the printing operation by the forward feed causes the continuous paper P to be fed in a state where the damper portion 15 does not function. As a result, a printing position is displaced off a planned position, or a print density is decreased, thus causing the problem of the degraded printing quality. Especially in the case where a width of the continuous paper is short, the continuous paper often deviates from the width adjustment guiding portion.

In contrast, in the embodiment, the depression portion 29 is disposed on the bottom surface inside the printer 1. The bottom surface of the depression portion 29 is positioned on the lower side compared with the bottom surface inside the printer 1. The continuous paper P is disposed so as to bridge the upstream side and the downstream side of the depression portion 29 because of rigidity of the continuous paper P itself. With this configuration, when the continuous paper P is fed backward from the printing unit 11 to the paper sheet supply unit 10 side, the continuous paper P abuts on the bottom surface inside the printer 1 without contacting the bottom surface of the depression portion 29.

In view of this, even in a state where the continuous paper P abuts on the bottom surface inside the printer 1, at the depression portion 29, the lower end of the width adjustment guiding portion 27 is positioned close to the bottom surface of the depression portion 29 compared with the continuous paper P. Accordingly, the continuous paper P is prevented from exceeding the lower end of the width adjustment guiding portion 27 to come outside the guide region restricted by the width adjustment guiding portion 27. Then, when returning to the printing operation by the forward feed, the continuous paper P does not run on the width adjustment guiding portion 27, and the function of the damper portion 15 is not hindered. Accordingly, the trouble, such as the printing position displaced off from the planned position, and a thinned printing density, can be avoided, thus ensuring the printing quality of the printer 1.

A cross-sectional shape of the depression portion 29 is formed such that an incline on the upstream side in the feed direction is more gradual than an incline on the downstream side in the feed direction. However, an inner wall surface of the depression portion 29 may be approximately perpendicular to the bottom surface inside the printer 1.

On the bottom surface inside the printer 1 including the depression portion 29, a plurality of protrusions (not illustrated), which extend along the feed direction of the continuous paper P, may be disposed along the width direction of the continuous paper P with predetermined intervals. These can make the flow of the continuous paper P smooth at the back feeding to reduce or prevent a trouble that the continuous paper P jams below the damper portion 15.

Next, the operation setting the continuous paper P on the paper passing route of the printer 1 will be described with reference to FIG. 8, FIG. 9, and similar drawing.

First, pulling the head lock lever portion 16 of the printing unit 11 illustrated in FIG. 8 rightward in FIG. 8, in conjunction with its operation, the lock claw portion 22 moves rightward to be released from the pin 20. Then, as illustrated in FIG. 9, while the front portion of the printing head portion 13 opens upward, the rear portion of the damper supporting member 25 rises in conjunction with the behavior, and the damper portion 15 also rises. This can extend a width below the damper portion 15.

Subsequently, the continuous paper P unwound from the paper sheet supply unit 10 passes through below the damper portion 15, and then passes through between the printing head portion 13 and the supporting stand 14. In this respect, since the damper portion 15 has rose and is open, the operation setting the continuous paper P can be facilitated.

Thereafter, as illustrated in FIG. 8, pressing the front portion of the printing head portion 13 to close the printing head portion 13 causes the printing head portion 13 to move to the closed position. Subsequently, the rear portion of the damper supporting member 25 moves down in the direction of the bottom surface inside the printer 1 due to the biasing force of the torsion spring 30, and the damper portion 15 also moves in the identical direction.

Therefore, the continuous paper P is nipped by the printing head portion 13 and the platen roller portion 23 to be pressed before the damper portion 15 abuts. In view of this, when the damper portion 15 moves to the closed state, the continuous paper P does not to come off from the platen roller portion 23 (cause the positional displacement) by being pulled by the damper portion 15.

While the embodiment of the present invention is described above, the above-described embodiment describes merely a part of application examples of the present invention and the gist does not limit the technical scope of the present invention to the specific configuration of the embodiment.

For example, according to the embodiment, a case that a continuous paper, which includes a plurality of labels adhered temporarily on a liner sheet, is used as a print medium has been described, but this should not be construed in a limiting sense; for example, a continuous label including an adhesive surface on one surface (a linerless label), a continuous sheet without an adhesive surface (continuous sheet), or, not limited to papers, a printable film by a thermal head or a similar film can be used as a print medium. The linerless label, the continuous sheet, or the film can include a position detection mark. In the case where the linerless label, where an adhesive is exposed, or a similar label is fed, a roller including silicone may be disposed while a non-adhesive coating is applied to a feed path.

This application claims the priority based on Patent Application No. 2016-196619 filed in the Japan Patent Office on Oct. 4, 2016, and every content of this application is incorporated herein by reference.

The invention claimed is:

1. A printer comprising:

a platen roller;

a printing head configured to be movable to a printing head closed position opposing the platen roller and a printing head open position separated from the platen roller, and configured to print on a print medium cooperating with the platen roller at the printing head closed position; and a damper interlocked with the printing head, and configured to be movable to a damper closed position abutting the print medium and a damper open position separated from the print medium, wherein the damper is configured to reach the damper closed position from the damper open position subsequent to the printing head reaching the printing head closed position.

2. The printer according to claim 1, wherein the damper is disposed on an upstream side of the printing head in a feed direction of the print medium.

3. The printer according to claim 1, wherein the damper is configured to move from the damper closed position to the damper open position as the printing head moves from the printing head closed position to the printing head open position.

4. The printer according to claim 1, further comprising:

a biasing member to bias the damper in a direction toward the damper closed position; and a locking member to lock the damper to the damper open position, wherein the locking member is configured to release the damper locked at the damper open position such that the damper moves and reaches the damper closed position from the damper open position, subsequent to the printing head reaching the printing head closed positon.

5. The printer according to claim 1, further comprising:

a head support configured to support the printing head and swing around a first rocking shaft; and a damper support configured to support the damper and swing around a second rocking shaft, the damper support is configured to interlock with the head support.

6. The printer according to claim 5, wherein the damper support comprises a groove, and the head support comprises a pin engaging with the groove.

7. The printer according to claim 6, wherein the groove comprises:

a first groove formed in a shape the pin travels when the printing head moves from the printing head closed position to the printing head open position;

a second groove formed in a shape the pin travels when the printing head moves from the printing head open position to the printing head closed position; and a third groove formed in an arc-shape having a center around the second rocking shaft and having a distance to the pin as a radius in a state where the printing head is on the printing head closed position, wherein the third groove connects an end portion of the first groove to an end portion of the second groove.

8. The printer according to claim 5, further comprising a locking member to lock the damper to the damper open position, wherein the locking member is configured to release the damper locked at the damper open position such that the damper moves and reaches the damper closed position from the damper open position, subsequent to the printing head reaching the printing head closed position.

9. A printer comprising:

a platen roller;

a printing head configured to be movable to a printing head closed position opposing the platen roller and a printing head open position separated from the platen roller, and configured to print on a print medium cooperating with the platen roller at the printing head closed position; and a damper interlocked with the printing head, and configured to be movable to a damper closed position abutting the print medium and a damper open position separated from the print medium, wherein the damper is configured such that the printing head reaching the printing head closed position opposing the platen roller causes the damper to move from the damper open position separated from the print medium, and subsequently, reach the damper closed position abutting on the print medium.

10. The printer according to claim 9, wherein the damper is disposed on an upstream side of the printing head in a feed direction of the print medium.

11. The printer according to claim 9, wherein the damper is configured to move from the damper closed position to the damper open position as the printing head moves from the printing head closed position to the printing head open position.

12. The printer according to claim 9, further comprising:

a biasing member to bias the damper in a direction toward the damper closed position; and a locking member to lock the damper to the damper open position, wherein the locking member is configured to release the damper locked at the damper open position such that the printing head reaching the printing head closed position opposing the platen roller causes the damper biased by the biasing member to subsequently reach the damper closed position.

13. The printer according to claim 9, further comprising:

a head support configured to support the printing head and swing around a first rocking shaft; and a damper support configured to support the damper and swing around a second rocking shaft, the damper support is configured to interlock with the head support.

14. The printer according to claim 13, wherein the damper support comprises a groove, and the head support comprises a pin engaging with the groove.

15. The printer according to claim 14, wherein the groove comprises:

a first groove formed in a shape the pin travels when the printing head moves from the printing head closed position to the printing head open position;

a second groove formed in a shape the pin travels when the printing head moves from the printing head open position to the printing head closed position; and a third groove formed in an arc-shape having a center around the second rocking shaft and having a distance to the pin as a radius in a state where the printing head is on the printing head closed position, wherein the third groove connects an end portion of the first groove to an end portion of the second groove.

16. The printer according to claim 13, further comprising a locking member to lock the damper to the damper open position, wherein the locking member is configured to release the damper locked at the damper open position such that the printing head reaching the printing head closed position causes the damper to subsequently reach the damper closed position.

* * * * *